US006149008A

United States Patent [19]

Yuhara

[11] Patent Number: 6,149,008

[45] Date of Patent: Nov. 21, 2000

[54] REFILLABLE CASE WITH A NET

[75] Inventor: Yukitomo Yuhara, Tokyo, Japan

[73] Assignee: Yoshida Kogyo Co., Ltd., Tokyo, Japan

[21] Appl. No.: 09/263,488

[22] Filed: Mar. 8, 1999

[51] Int. Cl.[7] ..... B65D 69/00

[52] U.S. Cl. ..... 206/581; 206/823

[58] Field of Search ..... 206/581, 823, 206/235, 37, 1.5; 132/293, 294, 298, 300, 301, 305, 306, 307, 314, 315, 316; 220/836, 845, 4.22, 4.24

[56] References Cited

U.S. PATENT DOCUMENTS

| | | | |
|---|---|---|---|
| 4,863,034 | 9/1989 | Contreras, Sr. | 206/581 |
| 5,107,871 | 4/1992 | Butcher et al. | 132/304 |
| 5,603,340 | 2/1997 | Gueret | 132/293 |
| 5,865,194 | 2/1999 | Gueret | 132/299 |
| 5,875,795 | 3/1999 | Bouix | 132/293 |
| 5,896,866 | 4/1999 | Quennessen | 132/293 |
| 5,908,037 | 6/1999 | Pierson | 132/293 |
| 5,950,639 | 9/1999 | Suzuki et al. | 132/294 |

*Primary Examiner*—Paul T. Sewell
*Assistant Examiner*—Nhan T. Lam

[57] ABSTRACT

A refillable case with a net for containing powdery cosmetic material includes a case body made of an elastic synthetic resin material having an opening opened upward for containing the powdery cosmetic material, and a net frame attached to cover the opening of the case body. The net frame has a net, an annular engagement member on which the net is placed, and an annular coupling portion located above the annular engagement member to set the net at a higher position than the annular engagement member to prevent the cosmetic material from leaking from the refillable case.

17 Claims, 32 Drawing Sheets

REFILLABLE CASE WITH A NET

BACKGROUND OF THE INVENTION

1. Field of the Invention

This invention relates to a refillable case with a net for containing a powdery cosmetic material and, more particularly, to a refillable case with a net capable of, upon elastic deformation of an inner case or case body in which such a powered cosmetic material is contained, extracting a cosmetic material in an appropriate amount through the surface net as well as preventing the cosmetic material from solidifying by rendering the cosmetic material fluid at every use and surely from leaking where a lid of the cosmetic case for containing the inner case or case body is closed.

2. Description of Related Art

Some powdery cosmetic materials such as foundations and face powders are currently contained in a refillable case in a disc or flattened cylinder shape in which a net is attached to an annular engagement member placed at a top opening. Such a refillable case has a structure that prevents the powdery cosmetic material from scattering by the net and can be used in application of the powdery cosmetic material in an appropriate amount through meshes of the net to a cosmetic tool such as a powder puff.

To improve feeling during use by removing projections at a welding portion between the edge of the case body and the net when a cosmetic tool applies the cosmetic material upon rubbing the net located on a top surface of the refillable case, a refillable case has been proposed in which any projection or gap is removed as shown in FIG. 6. A refillable case X, as shown in FIG. 6, is to be used upon contained in a compact cosmetic case 53 constituted of a lid 53A and a body 53B. The refillable case X includes a case body 51 for containing a powdery cosmetic material K and a net frame 52 in which a net 52*b* in a sheet form is tensioned on an annular engagement member 52*a*. The case body 51 is made of an elastic resin having a shallow disc shape and has a gently tapered round peripheral surface 51*b* formed between a bottom 51*a* and an opening edge 51*c*.

The annular engagement member 52*a* of the net frame 52 is a ring body having substantially the same diameter as the opening edge 51*c*, and the side surface of the member is placed around the opening edge 51*c* of the case body 51 and fits to the edge. The net 52*b* is secured to form a united body with the annular engagement member 52*a* in a way of insertion molding when the annular engagement member is made by injection mold. The top surface of the net 52 is positioned at that time to constitute the same level as the annular engagement member 52*a*, and an annular coupling portion for both becomes flat with no projection.

The compact cosmetic case 53 containing such a refillable container X is made by assembling a lid 53A and a case body 53B. The lid 53A and the container 53B have hinges 53*a*, 53*b* on one end and latches 53*c*, 53*d* on the other end, so that where the hinges are coupled with each other, the lid 53A is structured to be open and closed with respect to the case body 53B, and that where the latches 53*c*, 53*d* are engaged with each other, the case can keep its closed state.

An annular engagement 53*f* is formed around a round inner surface of the opening of the case body 53B. The refillable case X is immobilized within the compact cosmetic case 53 by engaging the annular engagement 53*f* with an engagement projection formed on a round side surface of the annular engagement member 52*a* of the refillable case X. A packing 54 serving as an elastic sheet is attached to a back of the lid 53A of the compact cosmetic case 3, so that this packing 54, by close contact with the net frame 52, prevents the powdery cosmetic material K from leaking when the lid 53A is closed.

Thus, with such a conventional refillable case, when the lid 53A of the compact cosmetic case 53 is closed, sealing must be assured where the lower surface of the packing 54 presses the surfaces of the annular engagement member 52*a* and the net 52*b* with certain pressure. Therefore, where the refillable case X thus described is used practically, the opening edge 51*c* of the case body 51 and the annular engagement member 52*a* of the net frame 52 require high molding accuracy, and such a case raises a problem that it may not have proper sealing property when having less accuracy due to occurrences of deformations such as curving or the like.

As a solution to such a problem, a method may be conceivable in which an outer periphery of the annular coupling portion 52*c* located between the annular engagement member 52*a* and the net 52*b* is positioned highly to keep the sealing by closely contacting that portion with the packing 54 of the lid 53A. With such a structure, the outer periphery linearly encroaches into the surface of the packing 54, so that the method does not require such a high accuracy.

Such a structure, however, creates a gap between the surface of the net 52*b* of the refillable case X and the packing 54 when the 53A of the compact case 53 is closed, thereby rendering the cosmetic material stray at this gap while the compact case 53 is carried, and raising a problem that when the lid 53A is opened, the cosmetic material clinging to the back surface of the packing 54 may be dispersed.

The powdery cosmetic material contained in a container is pressed toward the bottom of the container at every use by the net and the cosmetic tool. The cosmetic material is therefore solidified gradually, and as a result, the powdery cosmetic material may not be adequately, evenly transferred to the cosmetic tool when used, thereby raising a problem in which the cosmetic material and the container have to be discarded even though the powdery cosmetic material remains in the container.

Japanese Utility Model Publication (KOKOKU) No. Heisei 7-11,694 discloses a container for powdery cosmetic material solving the above problem. In this technique, a drum is formed in a cup shape of an elastic synthetic resin material, formed with a mesh at a top opening, and filled with a powdery cosmetic material, and the drum is contained in a recess in an outer case. With this powdery cosmetic case, proper powder as not so bulky can be supplied and used without any waste.

The powdery cosmetic case, however, raises a problem that the powdery cosmetic material is stored in a smaller amount because the volume becomes less as the drum has a cup shape whose bottom is small and whose top has a large diameter. To solve this problem, the case is required having a deeper depth in maintaining the drum in the cup shape or making larger the area of the upper opening, and in any event, this raises another problem that the whole container is needed to have a larger volume.

SUMMARY OF THE INVENTION

It is an object of the invention to provide a refillable case capable of surely sealing around a net frame with a lid, certainly preventing a cosmetic material from leaking, and making the cosmetic material in a large amount hardly cling to the lid for sealing the refillable case.

It is another object of the invention to provide a refillable case with a net for powdery cosmetic material having a structure for preventing the contained powdery cosmetic material from solidifying by rendering fluid the powdery cosmetic material contained in the case at every use of the powdery cosmetic material as well as rendering the volume of the case larger.

The foregoing objects are accomplished by providing a refillable case with a net for powdery cosmetic material including a case body made of an elastic synthetic resin material having an opening opened upward for containing a powdery cosmetic material, and a net frame attached to cover the opening of the case body. The net frame has the net, an annular engagement member on which the net is placed, and an annular coupling portion located above the annular engagement member to set the net at a higher position than that of the annular engagement member.

In another aspect of the invention, a refillable case with a net includes an inner case made of an elastic synthetic resin material for containing a powdery cosmetic material inside, a net frame, and an outer case. The inner case has a substantially flat bottom surface, a side surface extending upright from the bottom surface and having a curving portion that curves inward or outward, and a brim formed at a top edge of the side surface having a higher rigidity than the bottom surface and the side surface. The net frame has an annular engagement member fitted to the brim of the inner case and a net secured to the annular engagement member. The outer case has a recess of a prescribed depth into which the inner case is inserted and a bottom plate, for containing the inner case where the inner case contains the powered cosmetic material and where the net frame is engaged with the inner case.

According to an embodiment, the inner case may be formed with a projection formed on a prescribed position of the bottom surface. In another embodiment, the outer case has a bottom plate on which a projection is formed to be in contact with the bottom surface of the inner case. The net frame may be formed with an annular rib placed around the net.

In such a refillable case with a net for containing a powdery cosmetic material (hereinafter simply referred to as "refillable case"), the inner case is formed with a substantially flat bottom surface and has a side surface extending upright from the bottom surface and having a curving portion that curves inward or outward and a brim formed at a top edge of the side surface. The volume of the inner case can therefore be made larger than that of the conventional cup-shaped drum, so that the powdery cosmetic material can be contained much more in the inner case.

When a tool such as a puff or sponge is pressed on the net, force is transmitted to the inner case by way of the net frame and bends the curving portion that curves inward or outward and that is formed at the side surface of the inner case. According to this bending, the powdery cosmetic material contained in the inner case is made fluid without becoming solidified within the inner case. Where a projection is formed on either the bottom surface of the inner case or the outer case, such a projection hits the opposing surface when pressure is given, thereby deforming the bottom surface of the inner case according to the pressure. The side surface is also deformed from the curving portion as a start point, so that the volume of the inner case is made smaller according to the deformation of the bottom surface and the side surface, and so that the powdery cosmetic material contained in the inner case is made forcibly fluid without becoming solidified within the inner case. Particularly, where the powdery cosmetic material lefts in a small amount in the inner case upon used further, force exerted to the cosmetic tool is made larger to some extent, and the deformed amount of the inner case is also made larger, so that such force can adequately make fluid the powdery cosmetic material.

When the cosmetic tool is separated from the net, the side surface returns to its original state since the force deforming the inner case is removed. Air may pass through the net and introduced into the inner case, and during this introduction process, the powdery cosmetic material is further made fluid. Therefore, this refillable case prevents the powdery cosmetic material from solidifying where the powdery cosmetic material is contained in the inner case.

With the refillable case above, an annular rib may preferably be formed around the net constituting the net frame. Formation of the annular rib around the net makes the rib as a guide when the cosmetic tool is pressed on the net or when the cosmetic tool is separated from the net as well as shakes off the powdery cosmetic material clinging to the cosmetic tool, and can prevent the powdery cosmetic material that came out on the net from scattering around the net.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF PREFERRED EMBODIMENTS

Figure 1:
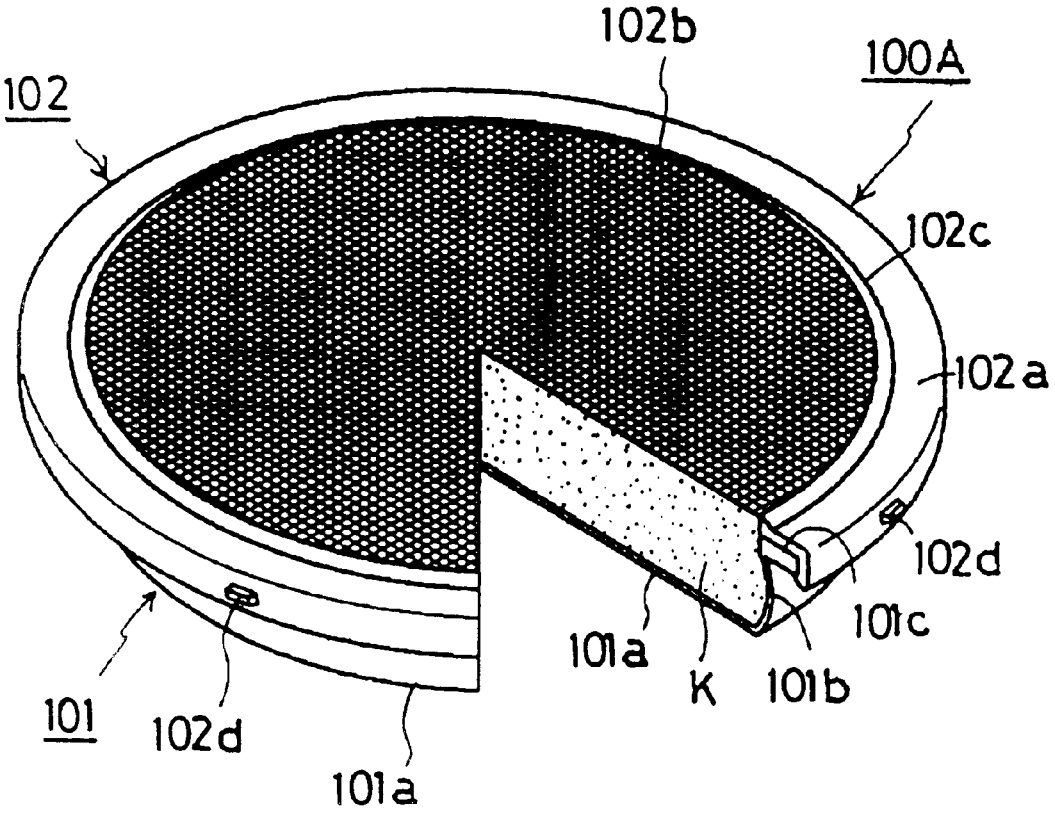
FIG. 1 is a perspective view showing a refillable case, partially broken, according to an embodiment of the invention.
Figure 2:
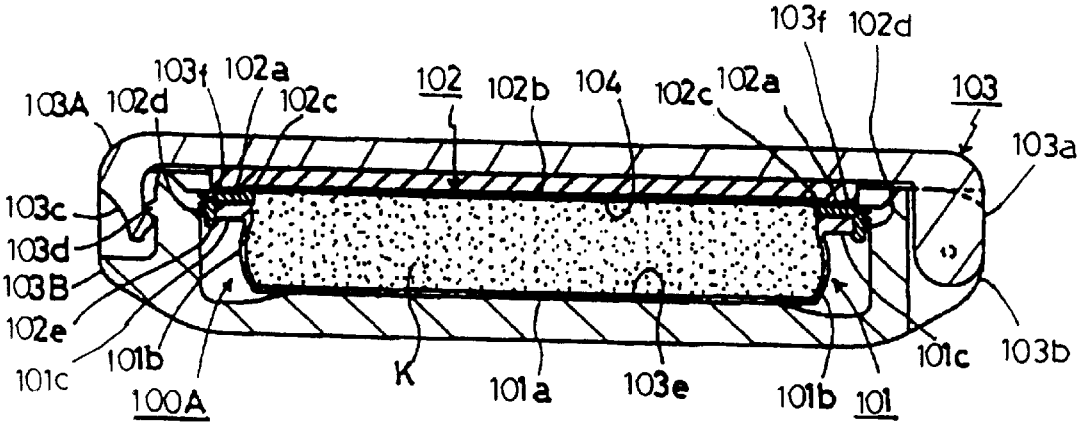
FIG. 2 is a side cross section showing a compact cosmetic case, into which the refillable case is incorporated, at a state while a lid is closed.
Figure 3:
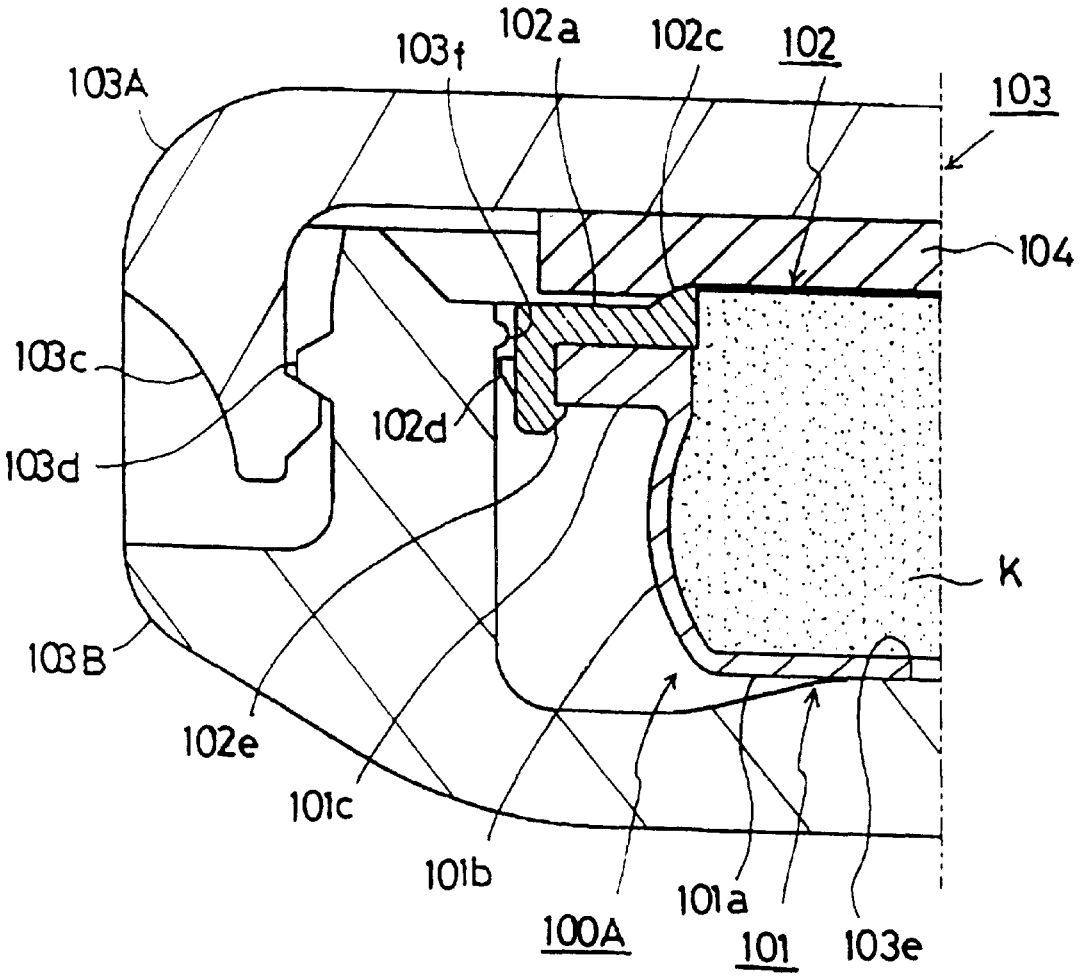
FIG. 3 is an enlarged cross section showing a net frame and its vicinity of the compact cosmetic case.
Figure 4:
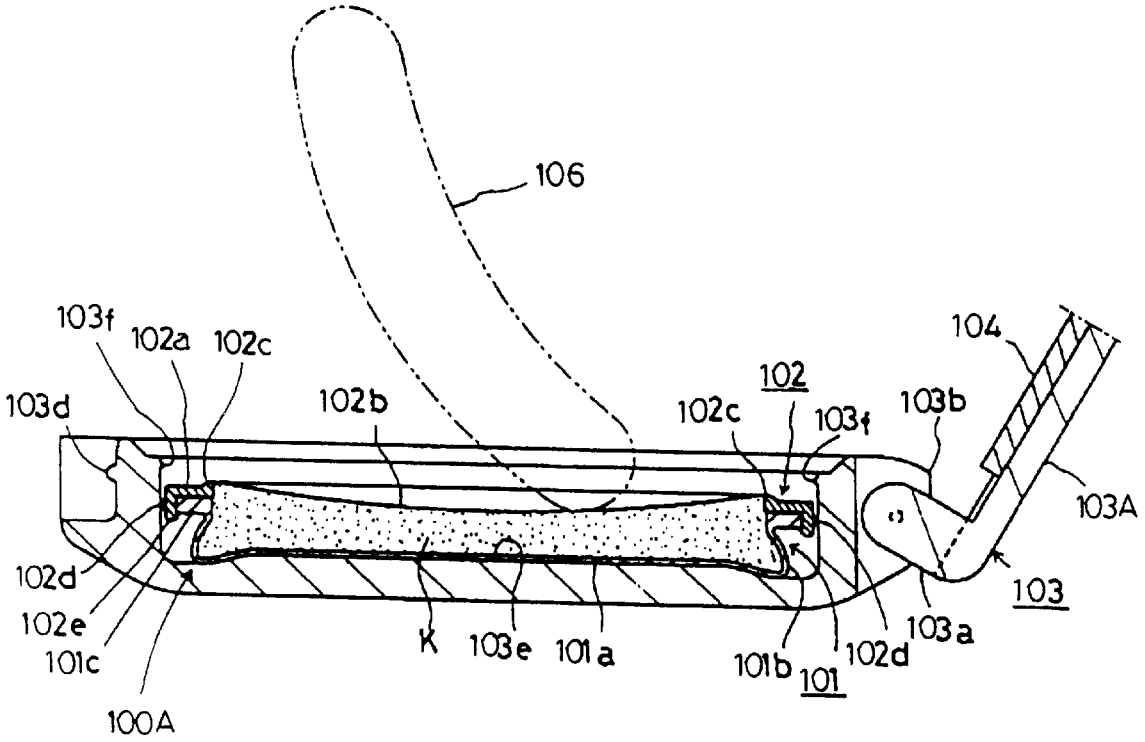
FIG. 4 is a side cross section showing the compact cosmetic case where its lid is opened.

Referring to FIGS. 1 to 4, a refillable case according to the invention is described. FIG. 1 is a perspective view showing a refillable case according to the first embodiment of the invention; FIG. 2 is a side cross section showing a compact cosmetic case, into which the refillable case is incorporated, at a state while a lid is closed; FIG. 3 is an enlarged cross section showing a net frame and its vicinity of the compact cosmetic case; FIG. 4 is a side cross section showing the compact cosmetic case where its lid is opened.

As shown in FIGS. 1 to 3, a refillable case 100A to be replaceable is contained in a compact cosmetic case 103. This refillable case 100A is constituted of a case body 101 and a net frame 102. The cosmetic material K contained in the case body 101 is a cosmetic material of a powdery type such as a foundation or facial powder or a paste type including some moisture.

The case body 101 is a shallow disc-shaped container and is constituted of a flat bottom 101*a,* a peripheral side surface 101*b* outwardly expanded likewise in a greater or lessor sign, and an opening edge 101*c*. The whole structure of the case body 101 is formed in a united body of an elastic synthetic resin material, e.g., an elastomer base material such as polyurethane. The case body 101, when pressed down, is collapsed as the peripheral side surface 101*b* is folded, thereby pushing up the contained cosmetic material with the bottom 101*a*.

The net frame 102 has a structure that a net 102*b* is tensioned at the inside of an annular engagement member 102*a* as a ring shaped body. This net frame 102 is manufactured by an insertion molding method in which a net 102*b* cut in a circle form is placed within a mold while the annular engagement member 102*a* is made by an injection molding to integrate the net with the member. An annular coupling portion 102*c* between the annular engagement member 102*a* and the net 102*b* is placed upright, so that the level of the net 102*b* is positioned higher than the surface of the annular engagement member 102*a*. That is, the net 102*b* is located above as floating over the annular engagement member 102*a* (see, FIG. 3).

The annular engagement member 102*a* of the net frame 102 thus formed has substantially the same diameter as the opening edge 101*c* of the case body 101 and makes a structure in which the case body 101 and the net frame 102 are fitted to each other by engagement of a latch 102*e* formed at the peripheral side surface of the annular engagement member 102*a* with the lower portion of the opening edge 101*c* of the case body 101 as the latch 102*e* extends along the surface of the annular engagement member 102*a*. An engagement projection 102*d* is formed on the peripheral side surface of the annular engagement member 102*a* to prevent the refillable case 100A from falling from the compact cosmetic case 103.

The refillable case 100A thus described is contained in the compact cosmetic case 103. This compact cosmetic case 103 is assembled with a lid 103A and a compact case body 103B. Provided on one end of the lid 103A and the compact case body 103B are hinges 103*a,* 103*b,* and provided on the other end of the lid 103A and the compact case body 103B are engagement projections 103*c,* 103*d*. The lid 103A is made openable with respect to the compact case body 103B, and where the engagement projections 103*c,* 103*d* are engaged, the compact cosmetic case can keep the closed state. A projection 103*e* is formed on the bottom in the compact case body 103B, and when the refillable case 100A is contained within the compact case body 103B, the refillable case 100A is mounted on the projection 103*e*.

An annular engagement 103*f* is formed on an inner peripheral surface of the opening of the compact case body 103B of the compact cosmetic case 103. When the refillable case 100A is fitted in the compact case body 103B, the engagement projection 102*d* formed on the peripheral side surface of the net frame 102 comes below the annular engagement 103*f,* thereby preventing the refillable case 100A from falling easily from the compact cosmetic case 103. Where the cosmetic material K within the refillable case 100A is used up and a user replace the used case with a new refillable case 100A, the engagement between the engagement projection 102*d* and the annular engagement 103*d* can be released by deforming the refillable case 100A in exerting force to the edge of the refillable case 100A, and the refillable case is easily taken out.

A packing 104 as an elastic sheet material is attached to a back surface of the lid 103A of the compact cosmetic case 103. This packing 104 is in close contact with the upper surface of the net frame 102 of the refillable case 100A where the lid 103A is closed, and therefore, thus surely prevents the cosmetic material K from leaking because the packing 104 covers across the whole mesh of the net 102*b*.

Referring to FIGS. 2 to 4, operation of the embodiment is described. The lid 103A of the compact cosmetic case 103 is closed as shown in FIG. 2 when the compact cosmetic case is stored or carried. At that time, the packing 104, attached to the back surface of the lid 103, is deformed as shown in FIG. 3 upon contacting the net 102*b* made upright and the annular coupling portion 102*c*, thereby surely sealing the mesh of the net 102*b* and the annular coupling portion 102*c* located around the net.

When the lid 103A of the compact cosmetic case 103 is opened when used as shown in FIG. 4, the packing 104 is released together with the lid 103A and exposes the net frame 102 in the refillable case 100A. Then, a cosmetic tool 106, such as a puff, is rubbed on the net frame 102 to apply the cosmetic material of a proper amount to the cosmetic tool 6.

Where the cosmetic tool 6 is pressed to the net frame 102 at that time, the bottom 101*a* of the case body 101 of the refillable case 100A is deformed upon contacting the projection 103*e* at the bottom of the compact case body 103B. In the refillable case 100A, the peripheral side surface 101*b* is thereby curved as folded likewise in an unequal sign to lower the position of the net 102*b*, and cosmetic material K in a proper amount can always be used according to the remaining amount of the cosmetic material K.

Thus, with the refillable case 100A according to the embodiment, when the lid 103A of the compact cosmetic case 103 is closed, the packing 104 is surely in contact with the surface of the net frame 102, thereby preventing the cosmetic material K from leaking.

Particularly, because, unlike the prior art example, no space is created between the net 102*b* and the packing 104, the refillable case can prevent the cosmetic material from becoming gathered in this space where the compact cosmetic case 103 is carried, thereby preventing the cosmetic material K from inconveniently scattering when the lid 103A is opened.

Figure 5:
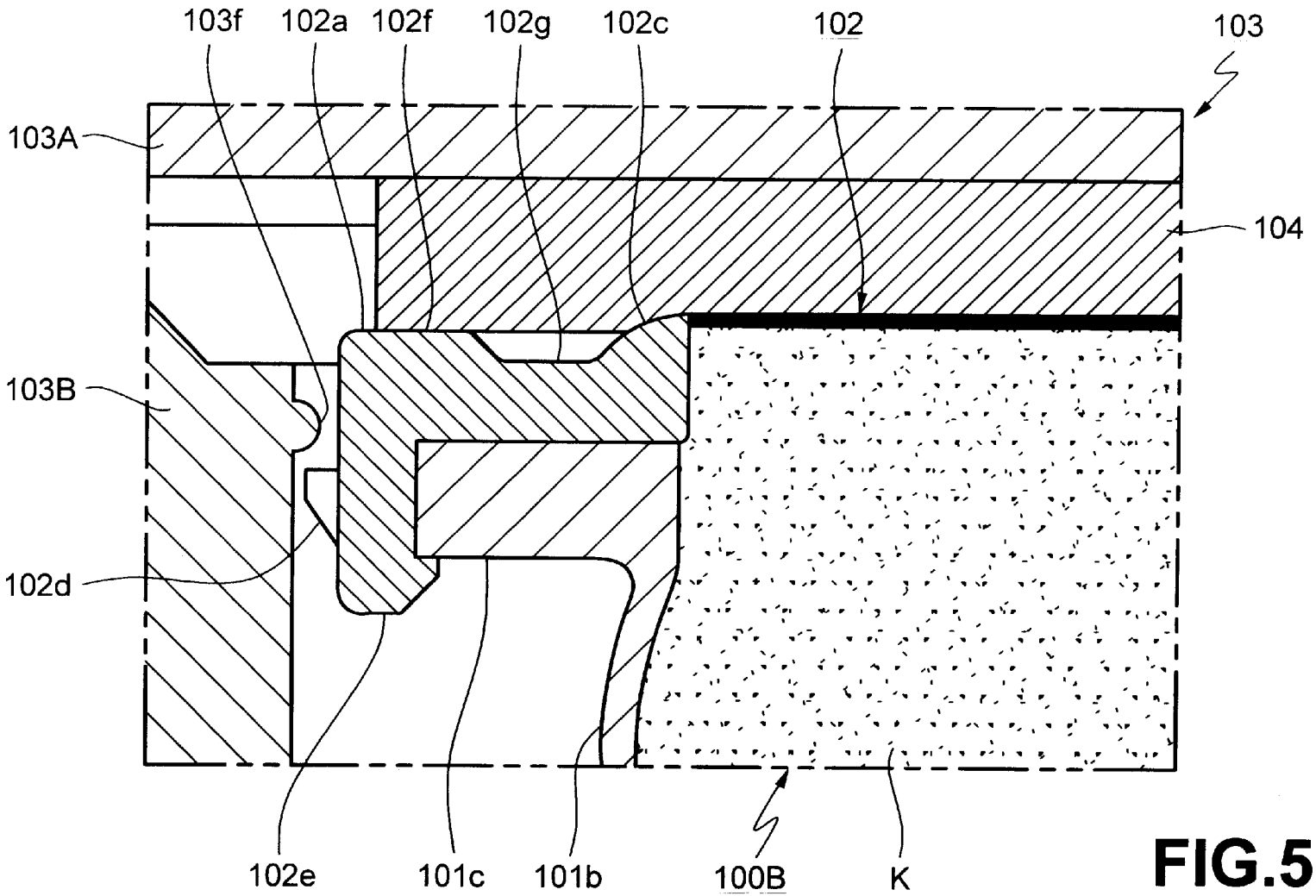
FIG. 5 is an enlarged cross section showing the net frame and its vicinity of the compact cosmetic case as another structural example of the refillable case according to a second embodiment.
Figure 6:
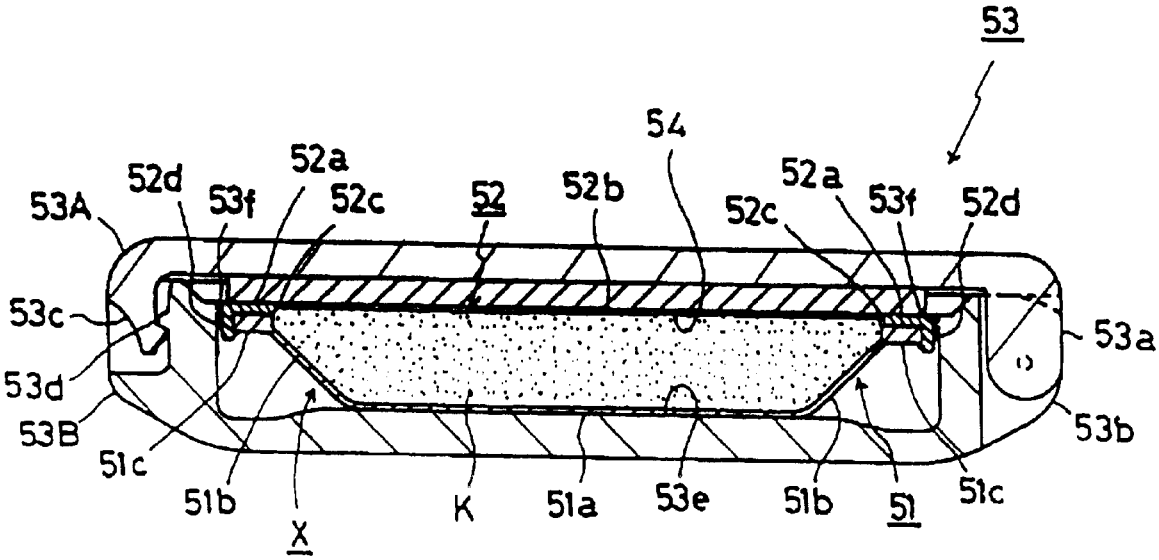
FIG.6 (Prior Art)
FIG. 6 is a side cross section showing a compact cosmetic case in which a conventional refillable case is incorporated.

FIG. 5 shows an enlarged cross section of the net frame and its vicinity of a compact cosmetic case in which a refillable case is structured with a partial modification, as the second embodiment of the invention. As shown in FIG. 5, the annular engagement member 102*a* of the refillable case 100B is formed with an annular plate 102*f* at a further outer edge of the annular coupling portion 102*c* which is located at a higher position. When the lid 103A is closed, the packing 104 also presses on the annular plate 102*f*.

Therefore, the refillable case 100B is sealed doubly by contacting the annular coupling portion 102*c* and the annular plate 102*f* with the packing 104, thereby surely preventing the cosmetic material K from leaking. It is to be noted that the annular plate 102*f* is designed to be located lower than the annular coupling portion 102*c*, so that when the packing 104 is pressed, the annular plate 102*f* pushes up the packing 404 as not to impair the sealing function of the annular coupling portion 102*c*.

Since an annular groove 102*g* is formed between the annular coupling portion 102*c* and the annular plate 102*f*, the groove 102*g* functions as a collector for the cosmetic material K, so that the cosmetic material K can be prevented from falling outside the compact cosmetic case 103 in going beyond the annular groove 102*g*.

It is to be noted that although in the refillable case and the compact cosmetic case the packing 104 is directly attached to the bottom surface of the lid of the compact cosmetic case to utilize it for opening the net frame of the refillable case, an inner lid for sealing may, as a matter of course, be formed as a separate body in the compact cosmetic case, and a packing can be formed on the back surface. A containing space for cosmetic tools may be created between the inner lid and a top lid.

As described above, in the refillable cases according to the first and second embodiments, when the lid of the compact cosmetic case containing the refillable case is closed, the packing mounted on the lid is in close contact with the net frame and the annular coupling portion located at the higher position, so that the refillable case guarantees sealing of a high degree and has an advantage to surely prevent the cosmetic material from leaking.

Since the refillable cases according to the first and second embodiments do not have any gap between the cases and the packing, the cosmetic material is not gathered in the gap, so that when the lid is opened during use, the refillable case can prevent the cosmetic material from suffering a problem such as scattering of the cosmetic material.

With the refillable case according to the invention, when the lid is closed to contain the refillable case, the packing, attached to the lid, makes close contact with the net frame and the annular coupling portion which are higher than the rest of the annular engagement member, so that the refillable case can keep high sealing and surely prevent the cosmetic material from leaking.

The refillable case according to the invention has no gap between the packing and the refillable case, so that the case does not gather the cosmetic material at any gap, and when the lid is opened to use the refillable case, the cosmetic material can be prevented from any disadvantage such as scattering or the like.

Now, referring to FIGS. 7 to 14, third to seventh embodiments according to the invention are described. The refillable case has an increased containing amount of a powdery cosmetic material without enlarging the outer case by using a cylindrical inner case having a bottom in which the size of the bottom is the same as the size of an opening formed at the top of the case.

The side face of the inner case is bent and deformed by force transmitted through a brim and exerted to the net where a curving portion that curves inward or outward is formed at the side surface of the inner case, and the powdery state of the cosmetic material is maintained in preventing the powdery cosmetic material from solidifying upon rendering the contained powdery cosmetic material fluid according to this deformation.

The inner case is molded with a prescribed volume of an elastic synthetic resin, such as polyurethane, polypropylene, etc., and is formed so that where force is exerted to the brim while the bottom is supported, the side surface is easily deformed according to this force and so that when the force is removed the inner case elastically returns to the original shape easily.

The brim of the inner case has a function to transmit pushing force to the side surface of the inner case when a cosmetic tool such as a puff or sponge is pressed onto the net constituting the net frame that engages with the brim. The brim is formed having a rigidity of a degree that the above force may not make the brim itself deformed. That is, the inner case is formed in which the bottom surface and the side surface are made with substantially the same thickness and in which the brim is made thicker than the bottom surface and the side surface. The brim is formed with a uniform thickness in a direction perpendicular to the top end of the side surface.

The net frame is constituted of an annular engagement engaged with the brim of the inner case and a net secured to the annular engagement. The annular engagement has a ring portion having substantially the same width as the width of the brim, and an engagement portion formed at an outer periphery of the ring portion. An engagement projection in engaging with the brim of the inner case is formed on an inner periphery side of the engagement portion, and an annular engagement engaging with the annular engagement formed on an inner peripheral surface of an outer case is formed on a side of the outer periphery. This annular engagement is molded by an injection molding of a synthetic resin material.

The net is made of a synthetic resin material such as a nylon and is secured by an insertion molding when the annular engagement is molded. This net requires to have a function, to transmit to the annular engagement and the brim of the inner case, the force associated with suppression of a cosmetic tool and does not require to hold great extension property.

The net frame thus described is engaged with the brim of the inner case, the brim and the annular engagement of the net frame are arranged doubly at the opening of the inner case, so that the rigidity is made higher. Accordingly, the force when the cosmetic tool is pushed onto the net is reasonably utilized as force to deform the side surface of the inner case. In accordance with shift of the pressed position where the cosmetic tool is pushed onto the net, the deformed position in the peripheral direction is shifted in the side surface of the inner case, thereby allowing the powdery cosmetic material contained in the inner case to be made uniformly fluid.

The net frame is preferably formed with an annular rib having a prescribed height around the net. This annular rib is formed on a top surface side of the annular engagement, and the top surface of the annular engagement and the inner peripheral surface of the rib are connected to each other with a curving surface. The annular rib therefore has a function as a guide when the cosmetic tool is pushed onto the net, a function of shaking off extra cosmetic material clinging to the cosmetic tool, and a function to prevent the powdery cosmetic material from coming out of the top surface through the net from scattering. Where the diameter of the annular rib is formed having substantially the same diameter of the cosmetic tool, the rib may also serve as a container for cosmetic tool during non-use.

The outer case has a function of containing the inner case. The outer case has a larger inner diameter than the outer diameter of the net frame. The outer case includes a recess having a depth equal to or larger than the height from the bottom surface of the inner case to the top surface of the net frame, and a bottom plate. An annular engagement in a ring shape is projected from the inner peripheral surface around the top end opening of the recess of the outer case. The outer case can be formed as a recess with a bottom formed at a part of the body for constituting the compact cosmetic case.

Figure 7:
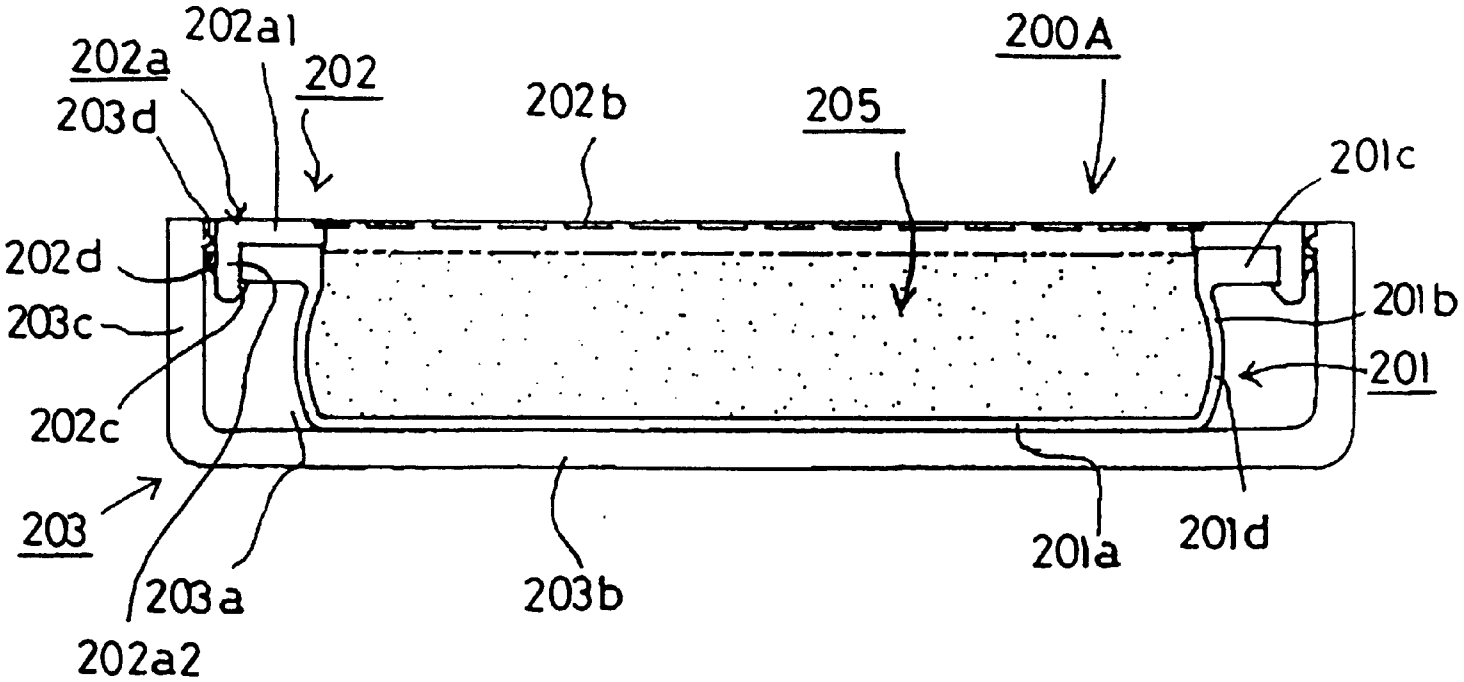
FIG. 7 is a cross section showing a structure of a refillable case according to a third embodiment of the invention.
Figure 8:
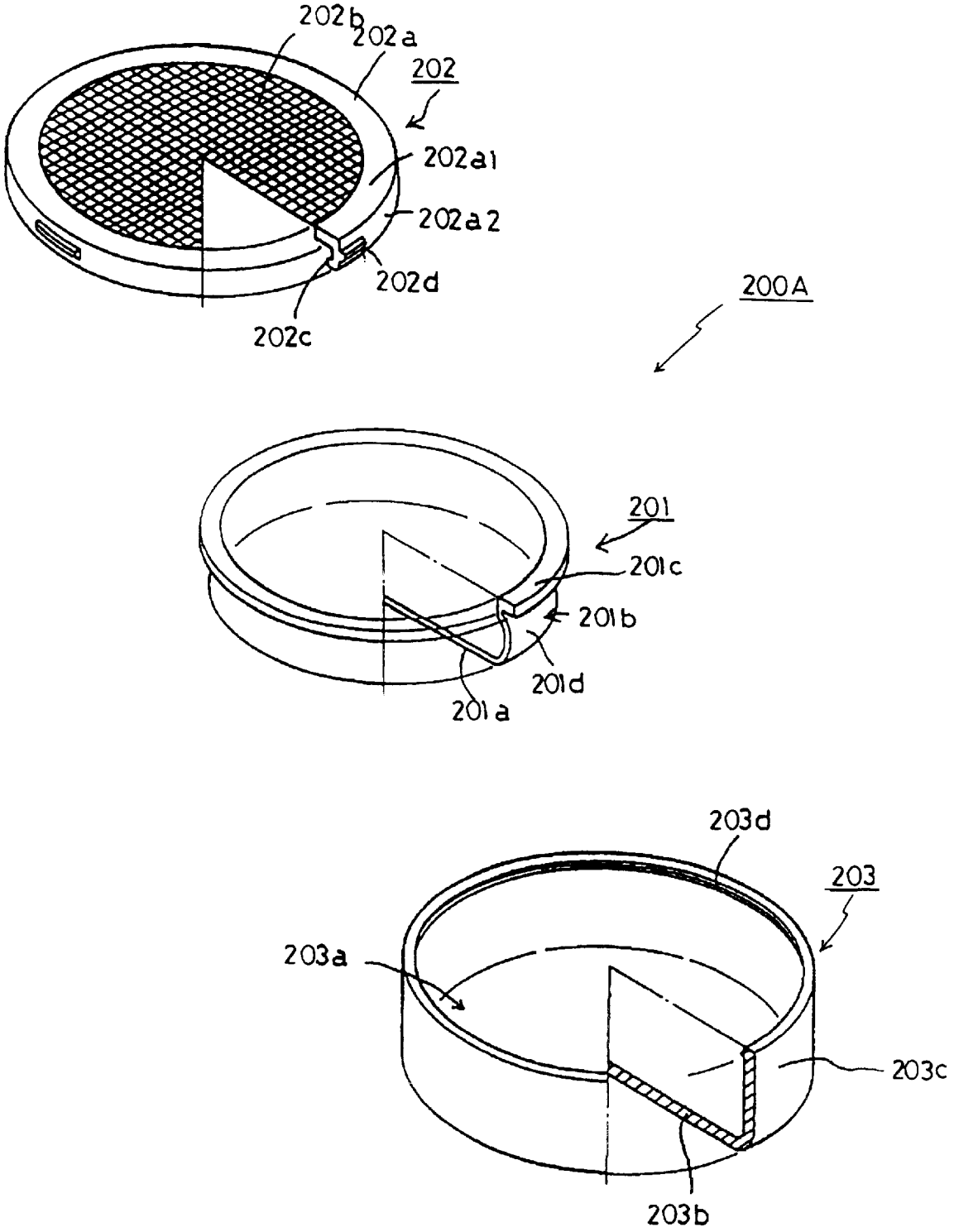
FIG. 8 is an exploded view showing the refillable case according to the third embodiment of the invention.

Hereinafter, referring to FIGS. 7 to 14, each embodiment is described. First, FIG. 7 is a cross section showing a refillable case 200A according to the third embodiment of the invention; FIG. 8 is an extended view showing the refillable case 200A. A bottom surface 201*a* of the inner case 201 is formed as a flat surface. A side surface 201*b* extends upright from the bottom surface 201*a,* and a brim 201*c* is formed in projecting in an outer peripheral direction on a top end of the side surface 201*b*. The bottom surface 201*a* and the side surface 201*b* are formed with substantially the same thickness, and the brim 201*c* is formed thicker than the bottom surface 201*a* and the side surface 201*b*. Accordingly, the brim 201*c* has a higher rigidity than those of the bottom surface 201*a* and the side surface 201*b*. A curving portion 201*d* that curves outward in an arc shape is formed at the side surface 201*b* of the inner case 201, so that the side surface 201*b* has a form like a drum by this curving portion 201*d*.

The net frame 202 includes an annular engagement 202*a* for engaging the brim 201*c* of the inner case 201*c* upon fitting to the brim 201*c,* and a net 202*b* secured to the annular engagement 202*a*. The annular engagement 202*a* includes a ring portion 202*a*1 having substantially the same width as that of the brim 201*a,* and an engagement 202*a*2 extending downward from the outer periphery of the ring portion 202*a*1.

An engagement projection 202*c* is placed at a position corresponding to the thickness of the brim 201*c* on an inner peripheral surface of the engagement 202*a*2. The engagement projection 202*c* is not necessarily engaged with the entire periphery of the brim 201*c,* and when the net frame 202 is fitted to the inner case 201, the engagement portion 202*c* may, without more, hold as to prevent the net frame 202 from disengaging from the inner case 201. In this embodiment, the engagement portion 202*a*2 are divided equally to four portions at which the engagement projection 202*c* is formed. An engagement projection 202*d* similar to the engagement projection 202*c* is formed on the outer peripheral surface of the engagement 202*a*2 at a position corresponding to the annular engagement 203*d* formed on the inner peripheral surface of the outer case 203.

The outer case 203 is formed with a recess 203*a* for containing the inner case 201 in which the net frame 202 is engaged, and a bottom plate 203*d* limits the depth of the recess 203*a*. That is, a plane shape of the recess 203*a* is substantially the same as the plane shape of the net frame 202, and the bottom plate 203*b* is formed at a position to make it larger than the distance from the bottom surface 201*a* of the inner case 201 to the surface of the ring portion 202*a*1 of the net frame 202. In this embodiment, the outer case 203 is formed in a cylindrical shape whose bottom is defined by a bottom plate 203*b,* and the recess 203*a* is formed within the cylinder portion 203*c* having a prescribed thickness.

An annular engagement 203*d* is formed at a prescribed position on the inner peripheral surface on a top end of the cylinder portion 203*c*. The annular engagement 203*d* has a function to prevent the inner case 201, contained in the recess 203*a* upon engagement with the engagement projections 202*d* formed at the engagement portions 202*a*2 of the net frame 202 in engaging with the net frame 202, from disengaging from the recess 203*a*.

Figure 13:
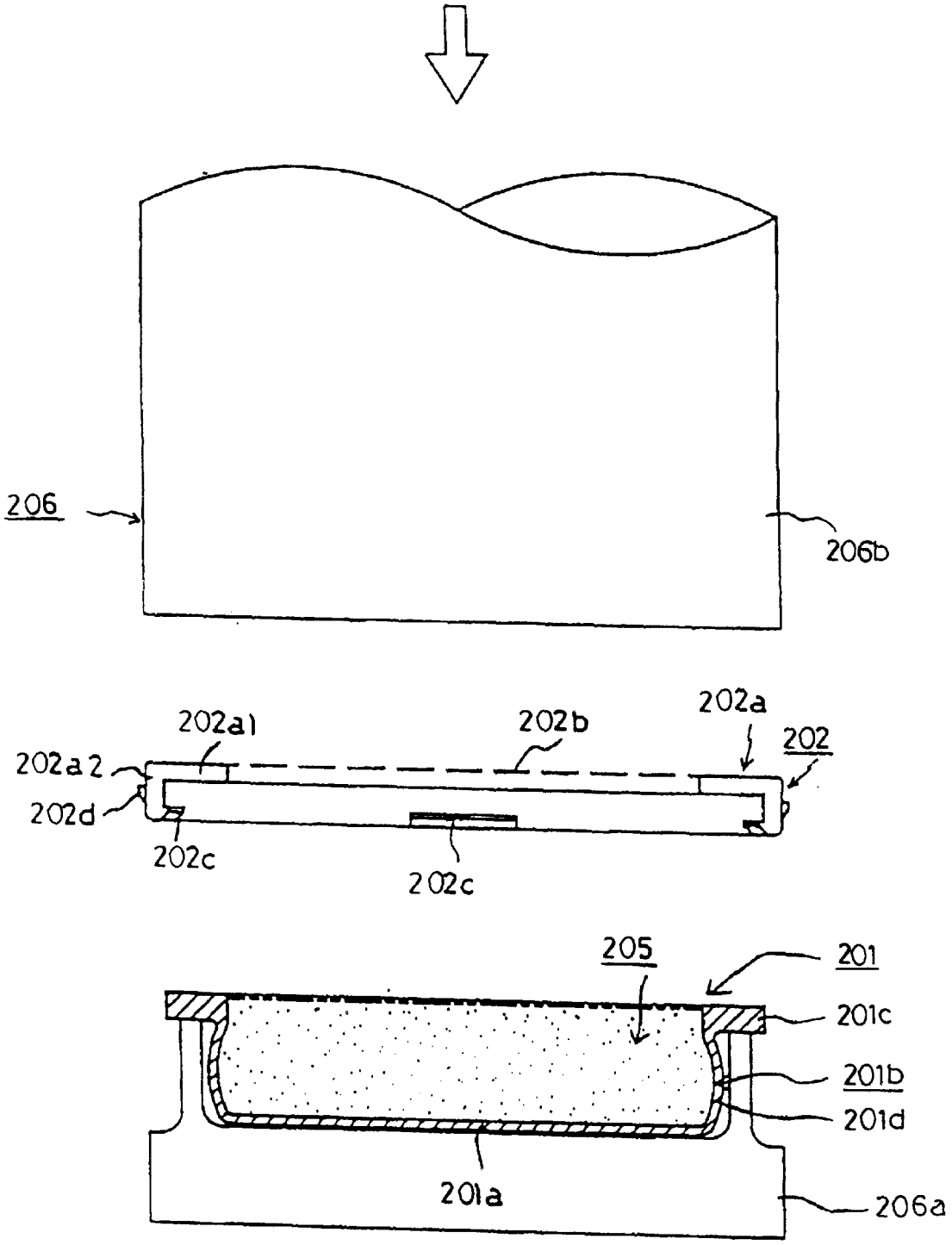
FIG. 13 is an illustration showing a step for rendering a net frame unify with an inner case.

Steps for composing the refillable case 200A with the inner case 201, the net frame 202, and the outer case 203 are as follows. First, a powdery cosmetic material 205 in an appropriate amount is put in the inner case 1. Subsequently, as shown in FIG. 13, the inner case 201 is provided at a die 206*a* of a lid attachment jig 206, and the net frame 202 is mounted to the inner case 201. This net frame 202 is urged by a punch 206*b* toward the inner case 201, thereby fitting the brim 201*c* to the annular engagement 202*a* and engaging the brim 201*c* by the engagement projections 202*c*. The net frame 202 can therefore be united with the inner case 201.

The inner case 201 and the net frame 202 thus united are contained within the recess 203*a* in the outer case 203 by using a pair of dies and punches, not shown, and the refillable case 200A as shown in FIG. 7 is thus formed. The engagement projection 202*d* of the net frame 202, united with the inner case 201, is engaged with the annular engagement 203*d* formed at the outer case 203, and therefore, the inner case 201 contained within the outer case 203 is prevented from moving in a direction for releasing itself from the outer case 203 and allowed to move in a direction toward the bottom plate 203*b* of the outer case 203.

Figure 9:
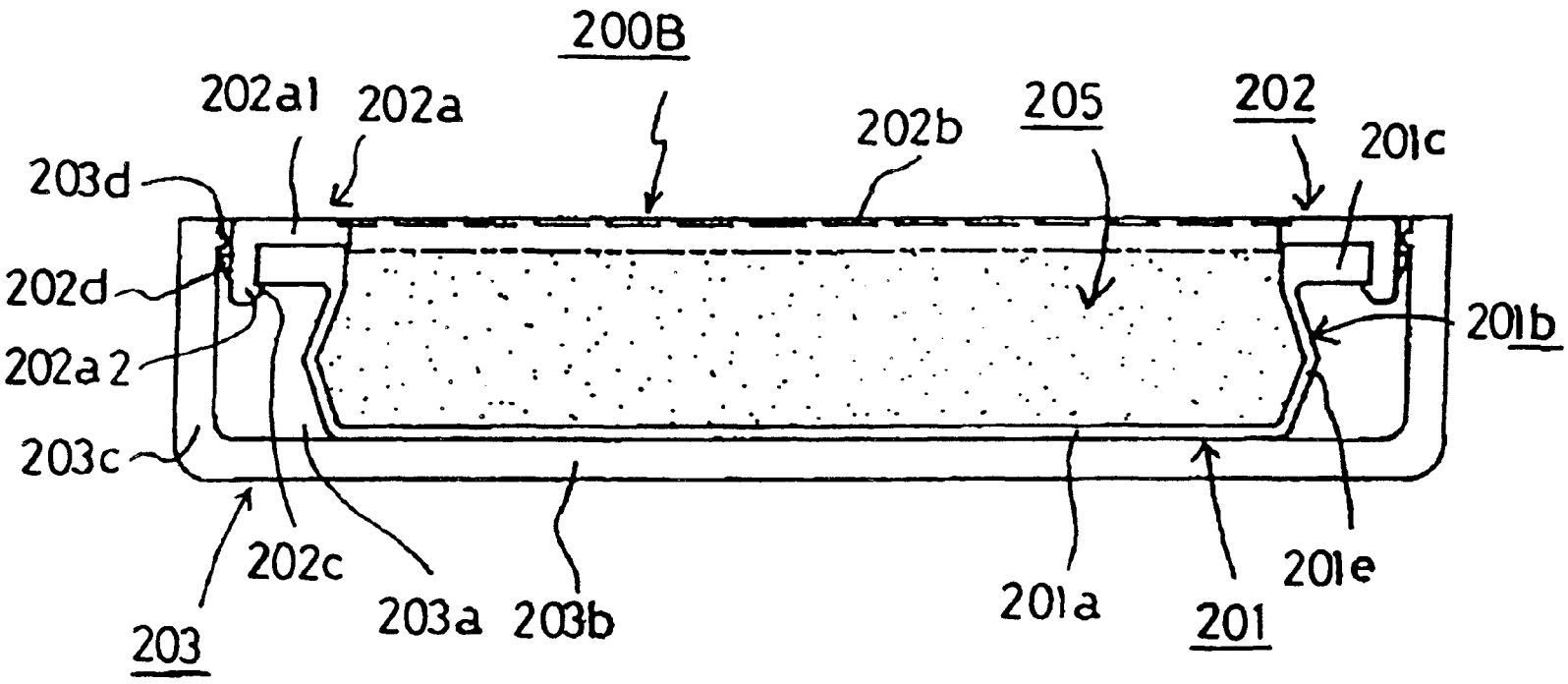
FIG. 9 is a cross section showing a structure of a refillable case according to a fourth embodiment of the invention.

FIG. 9 is a cross section showing a refillable case 200B according to the fourth embodiment of the invention. In this drawing, the same portions as those in the above first embodiment have the same reference numbers. The refillable case 200B in this embodiment is structured in the same manner except that the shape of the curving portion formed on the side surface 201*b* of the inner case 201 is different from the shape of the curving portion 201*d* in the first embodiment.

As shown in FIG. 9, a curving portion 201*e* is formed in curving in an unequal sign shape ("<") on the side surface 201*b* of the inner case 201. A projecting end of the curving portion 201*e* is arranged at a position outside with respect to the outer periphery of the bottom surface 201*a*. The side surface 201*b* has the curving portion 201*e* oriented outward.

Thus, the inner case 201 having the curving portion 201*e* that curves in the unequal sign shape toward the outside on the side surface 201*b* can be easily deformed by a smaller force in comparison with the curving portion 201*d* in an arc shape as in the first embodiment, so that the contained powdery cosmetic material 205 is guaranteed to keep its fluidity.

Figure 10:
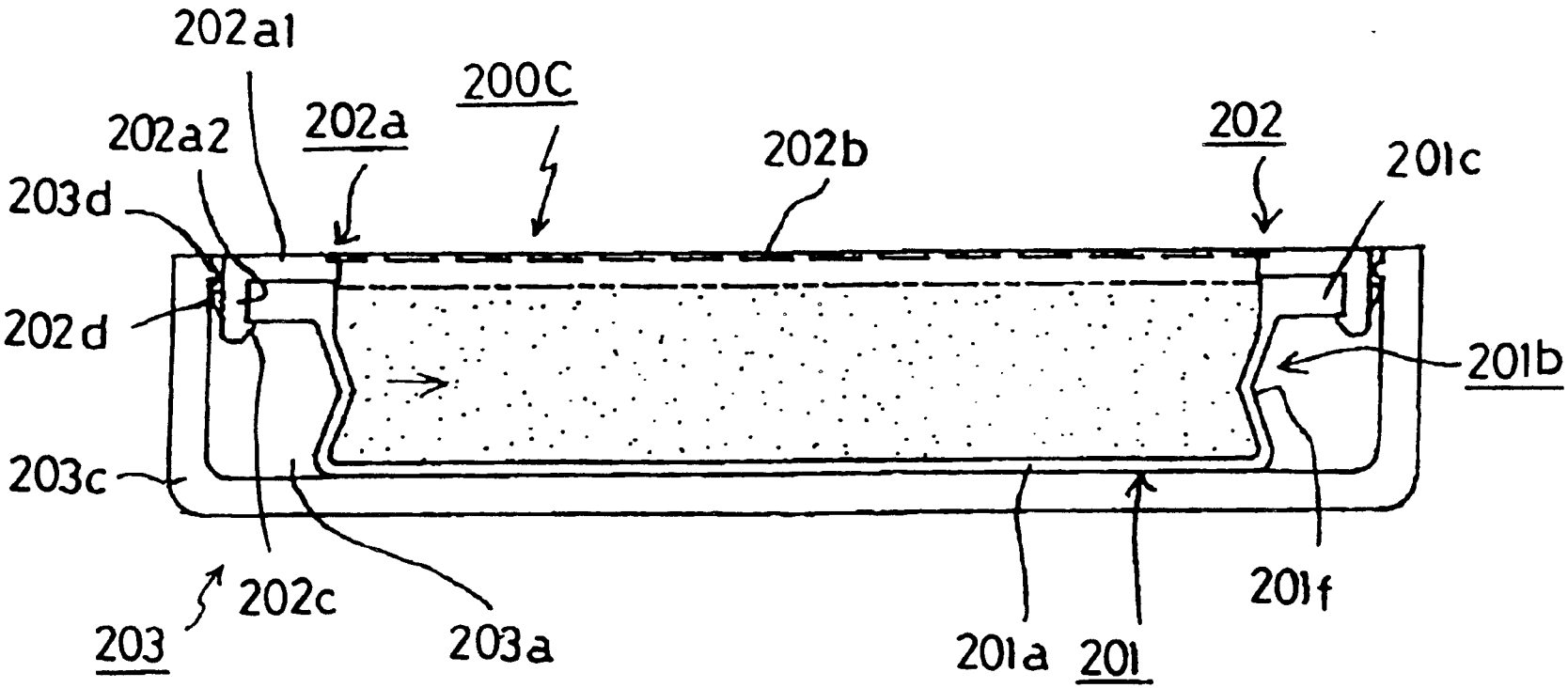
FIG. 10 is a cross section showing a structure of a refillable case according to a fifth embodiment of the invention.

FIG. 10 is a cross section showing a structure of a refillable case 200C according to a fifth embodiment of the invention. In this drawing, the same portions as those in the above first embodiment have the same reference numbers. The refillable case 200C in this embodiment is structured in the same manner except that the shape of the curving portion formed on the side surface 201*b* of the inner case 201 is different from the shape of the curving portion 201*d* in the first embodiment.

As shown in FIG. 10, a curving portion 201*f* is formed in curving in an unequal sign shape ("<") on the side surface 201*b* of the inner case 201. A projecting end of the curving portion 201*f* is arranged at a position inside with respect to the outer periphery of the bottom surface 201*a*. The side surface 201*b* has the curving portion 201*f* oriented inward.

Thus, the inner case 201 having the curving portion 201*f* that curves in the unequal sign shape toward the inside on the side surface 201*b* can be easily deformed by operation of smaller force as well as in the second embodiment, so that the contained powdery cosmetic material 205 is guaranteed to keep its fluidity, because according to the deformation of the curving portion 201*f* the projecting end of the curving portion 201*f* operates to make fluid the positively contained powdery cosmetic material 205.

Figure 11:
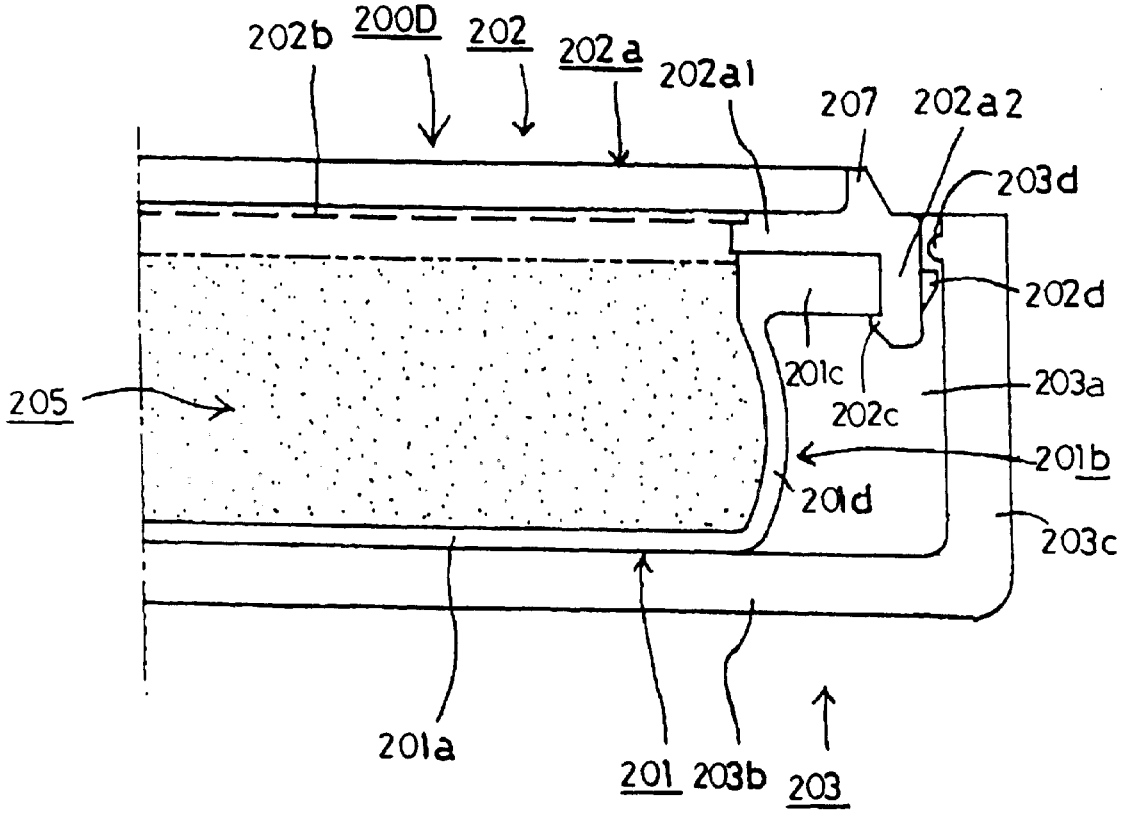
FIG. 11 is a cross section showing a structure of a refillable case having an annular projection around a net according to a sixth embodiment of the invention.

FIG. 11 is a cross section showing a refillable case 200D according to the sixth embodiment of the invention, partially broken, formed with an annular rib around the net 202*d* constituting the net frame 202. In FIG. 11, the same portions as those in the above first embodiment have the same reference numbers.

In FIG. 11, the annular rib 207 is formed around the net 202*d* constituting the net frame 202. This rib 207 has a function that prevents the powdery cosmetic material 205 that came out on the surface of the refillable case 200D through the net 202*b* from scattering from the net frame 202 and a function that shakes off extra powdery cosmetic material 205 clinging to the cosmetic tool 204 after the powdery cosmetic material 205 is applied where the cosmetic tool 204 is pushed on the net 202*b*.

The rib 207 is formed with a prescribed height at the ring portion 202*a*1 of the annular engagement 202*a* constituting the net frame 202 and formed as to surround the net 202*b*. The rib 207 can be placed on the ring portion without any special restriction. However, the rib 207 is preferably placed at a position for forming substantially the same diameter as that of the cosmetic tool 204, and if such a rib 207 is formed, the cosmetic tool 204 can be contained in an area surrounded by the rib 207 on the top of the net frame 202.

Figure 12:
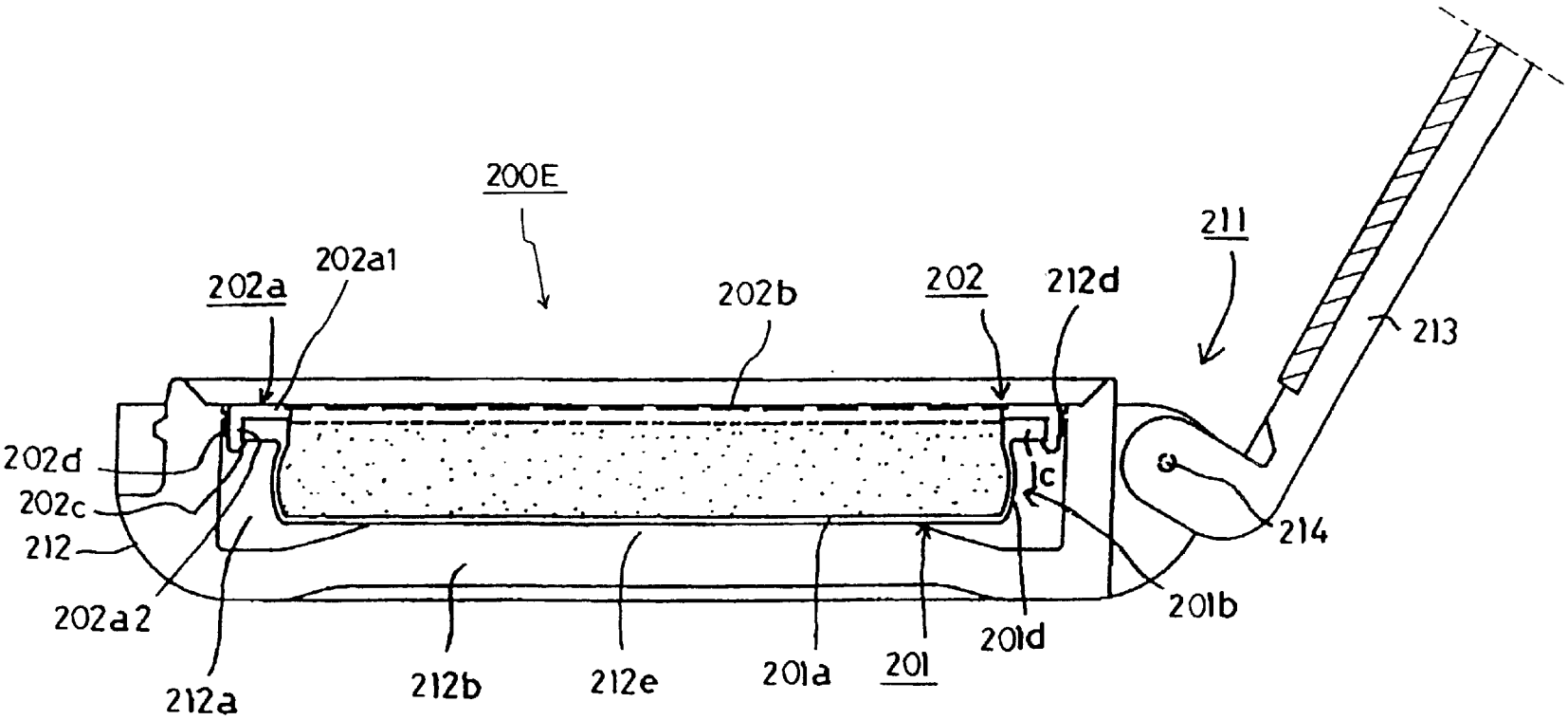
FIG. 12 is a cross section showing a structure of a refillable case utilizing a part of the body of the compact cosmetic case serving as an outer case according to a seventh embodiment of the invention.

A refillable case 200E according to the seventh embodiment of the invention shown in FIG. 12 has an outer case serving as a body 212 of the compact cosmetic case 211, and an inner case 201 united with the net frame 202 is contained within a recess 212*a* formed in the body 212. The inner case 201 and the net frame 202 are the same as those in the first embodiment.

In FIG. 12, the compact cosmetic case 211 has the body 212 and a lid 213, which are mounted as to be openable by a hinge pin 214. The recess 212*a* for containing the inner case 201 is formed at a prescribed position of the body 212.

The recess 212*a* is formed with the same specification as the recess 203 in each above embodiment. That is, the depth of the recess 212*a* is defined by the bottom plate 212*b*, and an annular engagement 212*d* is formed on the top. The inner case 201 contained in the recess 212*a* is prevented from moving in a direction disengaged from the recess 212*a* by engaging the engagement projection 202*d* of the net frame 202 with the annular engagement 212*d* formed at the recess 212*a*, thereby allowing to move only downward of the recess 212*a*.

As described above, as the outer case for containing the inner case 201 with which the net frame 202 is united, an outer case 203 is not necessarily in a cylinder shape having a bottom, and works as far as recesses 203*a*, 212*a* are capable of containing the inner case 201. That is, the outer shape of the outer case 203 can be made in various shapes such as a cylindrical shape or a plate shape.

Figure 14:
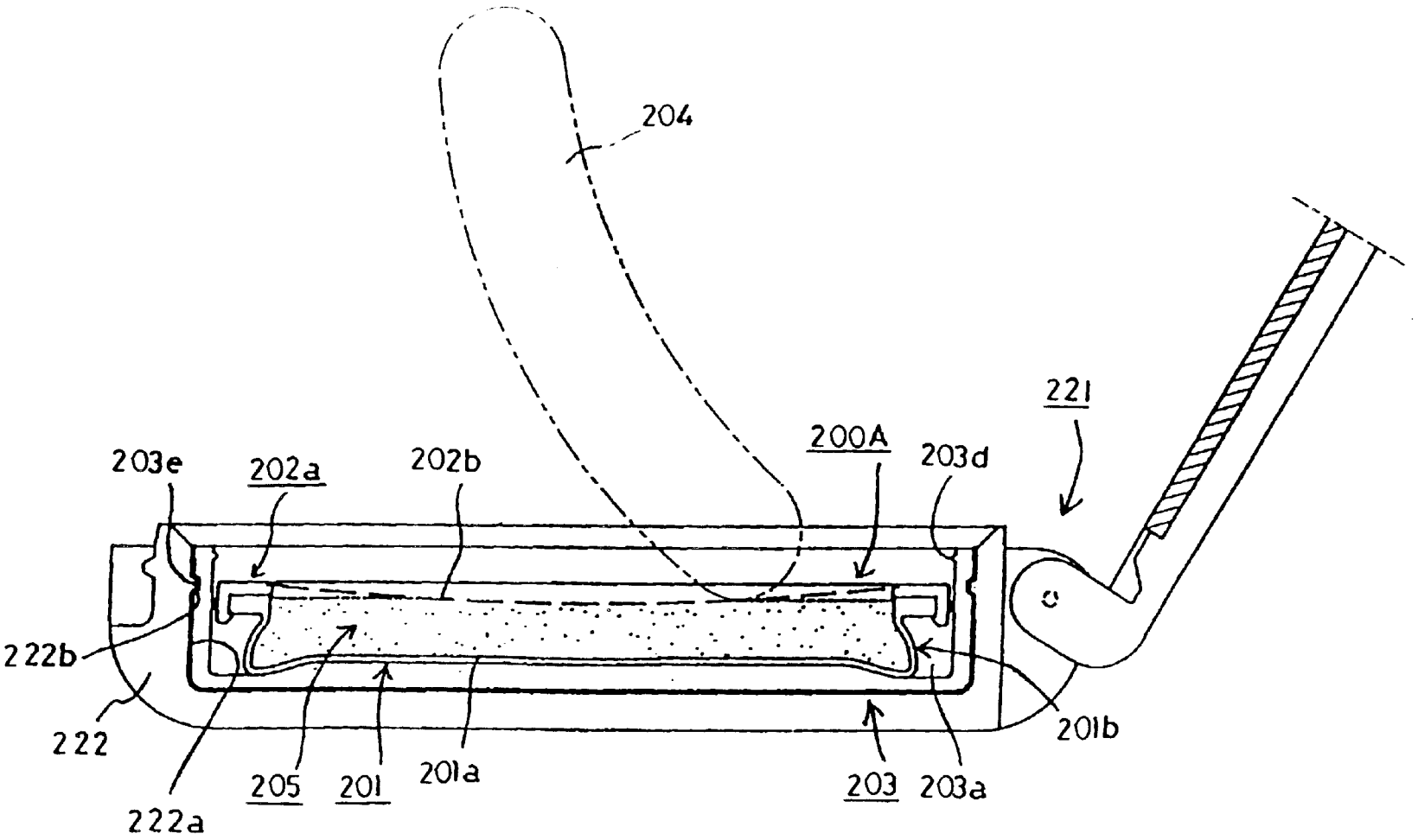
FIG. 14 is a cross section showing a deformed state of the inner case while a refillable case is used.

Referring to FIG. 14, fluidity in the powdery cosmetic material 205 during use of the refillable case thus structured is described. In this drawing, as a refillable case, the refillable case 200A according to the first embodiment is used, and the outer case 203 of the refillable case 200A is contained within a containing section 222*a* formed in the body 222 of the compact cosmetic case 221. It is to be noted that an engagement groove 203*e* is formed on an outer peripheral surface of the outer container 203 and that the groove 203*e* prevents the outer case 203 from disengaging from the body 222 of the refillable case 200A by engagement with the engagement projection 222*b* formed at the containing section 222*a* of the body 222.

When the powdery cosmetic material 205 is contained much in the inner case 201 in the refillable case 200A, and when a cosmetic tool 204 is slightly pushed onto the net 202, the net 202 is bent slightly by this pushing force to make contact with the topmost surface of the powdery cosmetic material 205, so that the powdery cosmetic material 205 transfers on the cosmetic tool 204 in exposing itself on the net 202 in passing the net 202.

According to reduction of the powdery cosmetic material 205 contained in the inner case 201, the net 202 may not come into contact with the powdery cosmetic material 205 even where cosmetic tool 204 is pushed onto the net 202*b*, so that larger force to push the cosmetic tool 204 is required.

This pushing force is transmitted, at the same time as the net 202*b* is bent, to the side surface 201*b* and the bottom surface 201*a* via the annular engagement 202*a* and the brim 201*c* from the net 202*b*. the net frame 202 moves according to application of the pushing force toward the bottom plate 203*b* of the outer case 203. Since the bottom surface 201*a* of the inner case 201 is in contact with the bottom plate 203*b* of the outer case 203, the bottom surface 101*a* is supported along the bottom plate 203*b* to bend the side surface 201*b* as to deform the side surface, thereby reducing the volume of the inner case 201.

The topmost level of the powdery cosmetic material 205 contained in the inner case 201 is therefore lifted up relatively to make contact with the net 202*b*, and the powdery cosmetic material 205 is exposed upon passing the net 202*b* and attached to the cosmetic tool 204. According to the deformation of the side surface 201*b*, the contained powdery cosmetic material 205 is made fluid within the inner case 201 to prevent the material from solidifying, so that the refillable case can keep the powder state. When the cosmetic tool 204 is separated from the net 202*b*, the side surface 201*b* of the inner case 201 returns to the original form, and the contained powdery sheet materials 205 is agitated by passing air through the net 202*b* as to flow through the inside of the inner case 201 during this returning process, so that the cosmetic material 205 can be effectively prevented from solidifying.

As described above, in the inner case 201, the side surface 201*b* is deformed according to the size of force exerting to the net 202*b*. Since the contained powdery cosmetic material 205 is compulsively made fluid according to deformation of the inner case 201, the cosmetic material 5 can always keep the fluidity without solidifying.

Referring to FIGS. 15 to 20, examples of the compact cosmetic case are described. The compact cosmetic case shown in those drawings can use, selectively, one of the refillable cases 200A to 200E. To avoid repetitive descriptions, only an example in which the refillable case 200A according to the first embodiment is used is described.

Figure 15:
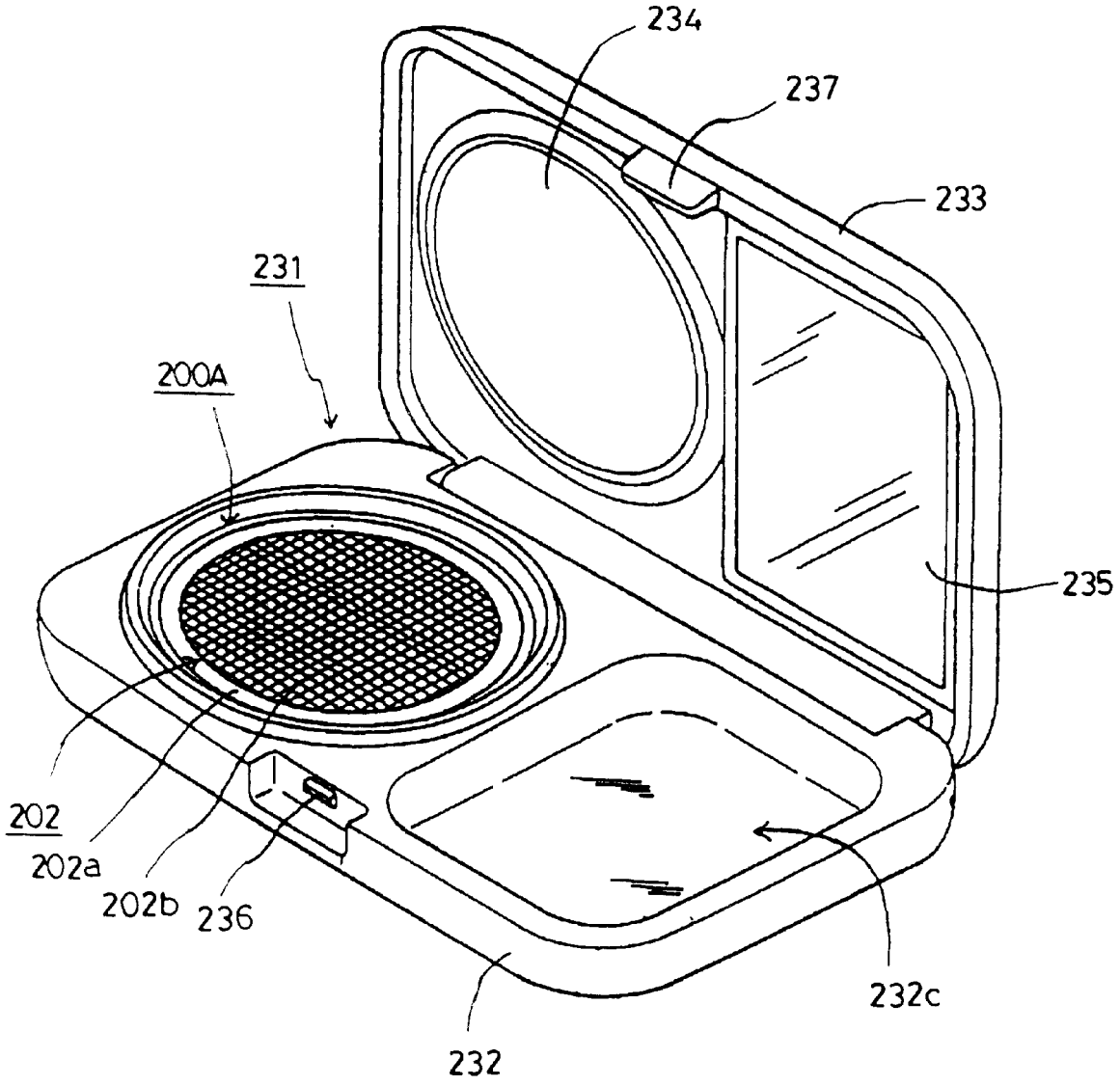
FIG. 15 is a perspective view showing a parallel type compact cosmetic case.
Figure 16:
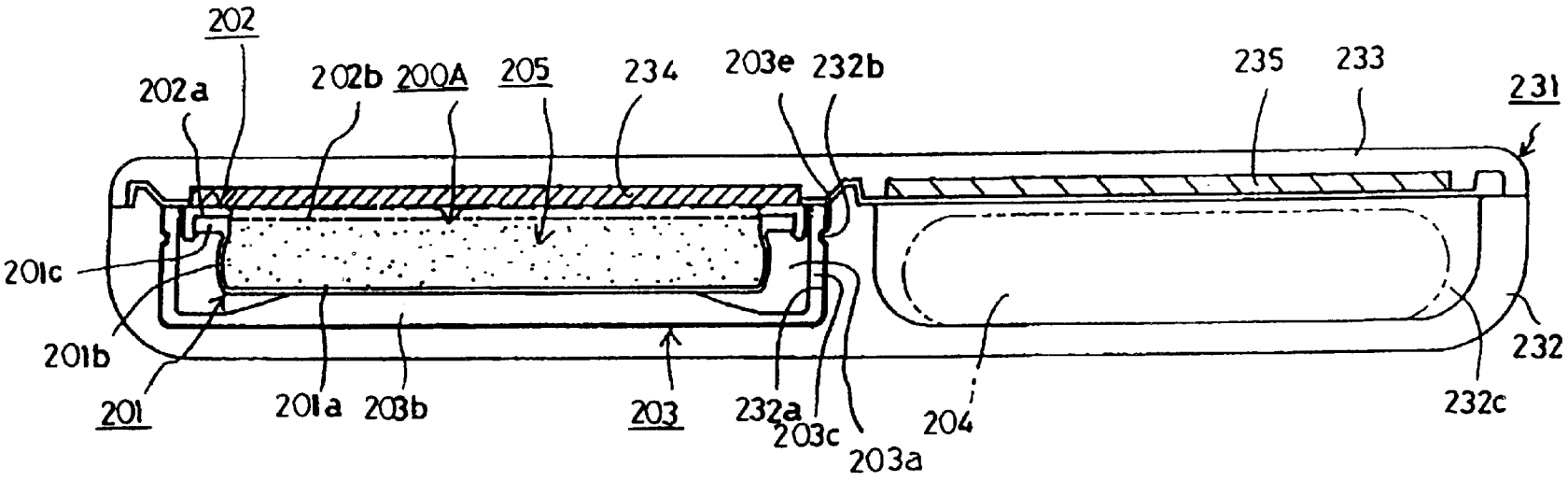
FIG. 16 is a cross section showing the parallel type compact cosmetic case.

FIG. 15 is a perspective view showing a so-called parallel type compact cosmetic case 231 in which the refillable case 200A and a cosmetic tool 204 are arranged in parallel; FIG. 16 is a cross section showing the compact cosmetic case 231 in a closed state.

In FIG. 15, the compact cosmetic case 231 is structured by connecting a body 232 and a lid 233 with each other via a hinge not shown; during non-use, the upper side of the refillable case 200A disposed at the body is closed, and during use the lid is made open. A containing section 232*a* for containing the outer case 203 of the refillable case 200A is formed at the body 231, and an engagement projection 232*b* is formed at a prescribed position on an inner peripheral surface of the containing section 232*a*. A containing section 232*c* for containing a cosmetic tool 204 is formed parallel to the containing section 232*a*.

A packing 234 for preventing the powdery cosmetic material 205 contained in the inner case 201 from drying by covering the net frame 202 of the refillable case 200A is mounted at a position corresponding to the containing section 232*a* on the inner surface of the lid 233. A mirror 235 is attached to a position corresponding to a container section 232*c*.

An engagement projection 236 and an engagement hook 237 are disposed at positions corresponding to each other on the opposition side to the hinge between the body 232 and the lid 233. Therefore, the compact cosmetic case 231 can be closed by engaging the engagement projection 236 with the engagement hook 237 upon pivotal movement of the body 232 and the lid 233, and the compact cosmetic case 231 can be released by disengaging the engagement projection 236 from the engagement lid 233.

An engagement groove 203*e* is formed at a position corresponding to the engagement projection 232*b* formed at the containing section 232*a* of the compact cosmetic case 231 on an outer peripheral surface of the outer case 203 constituting the refillable case 200A. The refillable case 200A is prevented from disengaging from the containing section 232*a* by fitting the engagement projection 232*b* to the engagement groove 203*e* by pushing the refillable case 200A into the containing section 232*a*. The compact cosmetic case 231 thus constituted has a thinner thickness though having a relatively larger area.

Figure 17:
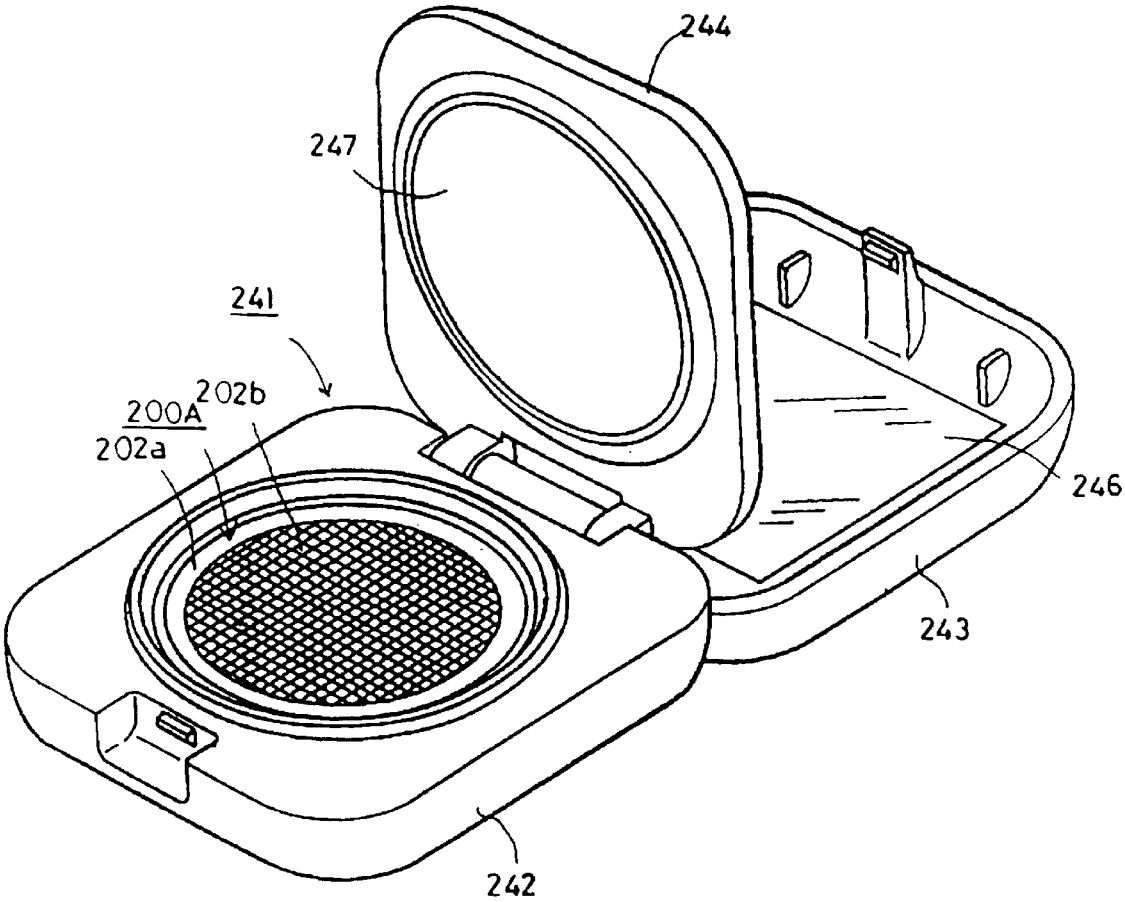
FIG. 17 is a perspective view showing a multistage type compact cosmetic case.
Figure 18:
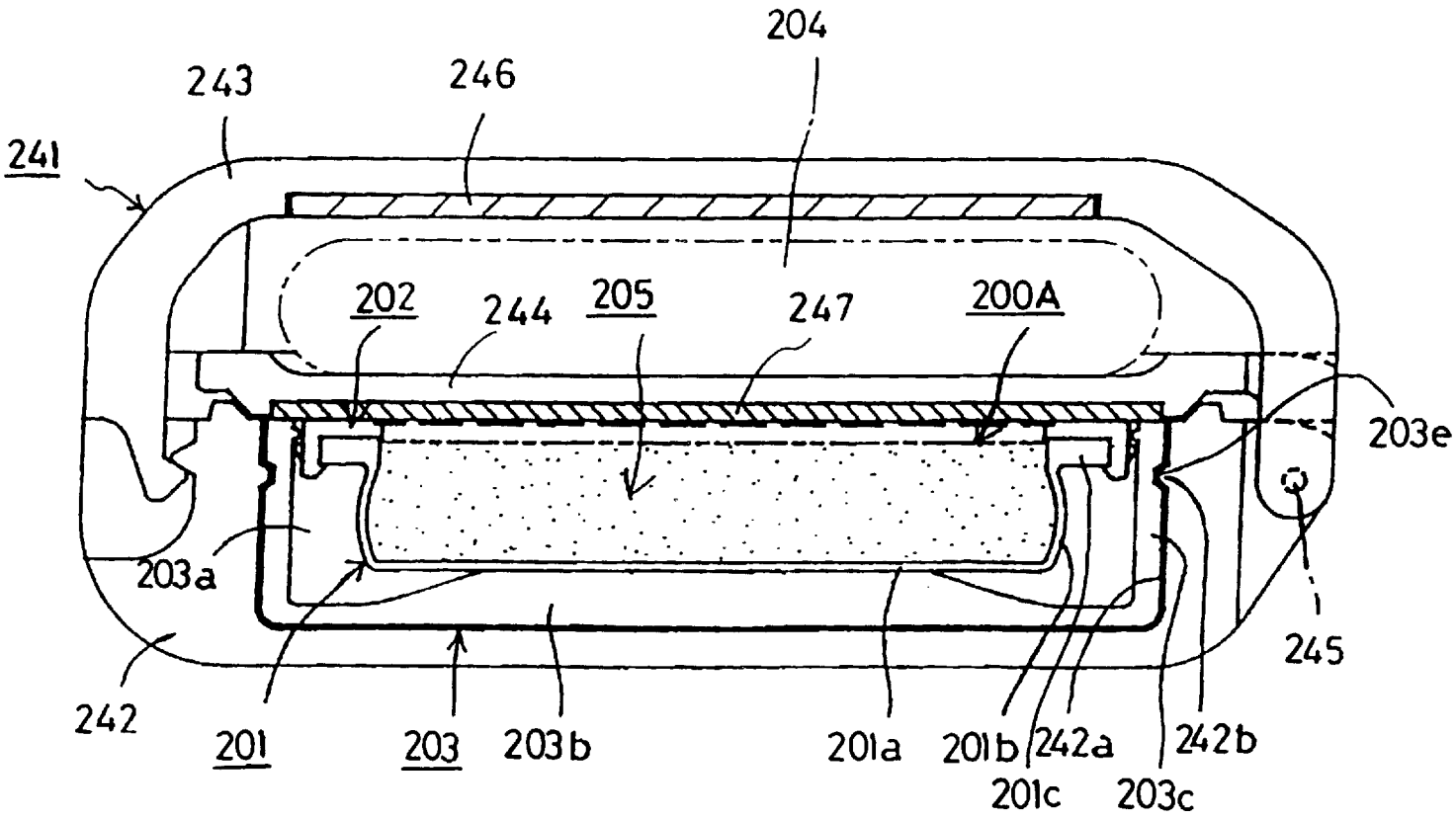
FIG. 18 is a cross section showing the multistage type compact cosmetic case.

FIG. 17 is a perspective view showing a so-called multistage type compact cosmetic case 241 in which the refillable case 200A and a cosmetic tool 204 are arranged vertically; FIG. 18 is a cross section showing the compact cosmetic case 241 in a closed state.

In FIG. 17, the compact cosmetic case 241 includes a body 242, a lid 243, and an inner lid 244, which are connected so that each can pivotally move around a hinge pin 245. A containing section 242*a* is formed on the body 242 that has the engagement projection 242*b*, and the refillable case 200A is secured by engagement of the engagement projection 242*b* with the engagement groove 203*e* where the refillable case 200A is pushed in the containing section 242*a*.

A mirror 246 is attached to an inner surface of the lid 243. A packing 247 is attached on a surface of the inner lid 244 on a side of the body 242 for preventing the powdery cosmetic material 205 contained in the refillable case 200A from drying, and a surface on the side of the lid 243 serves as a containing section for containing the cosmetic tool 204. The compact cosmetic case 241 thus constituted has a thinner thickness though having a relatively larger area.

Figure 19:
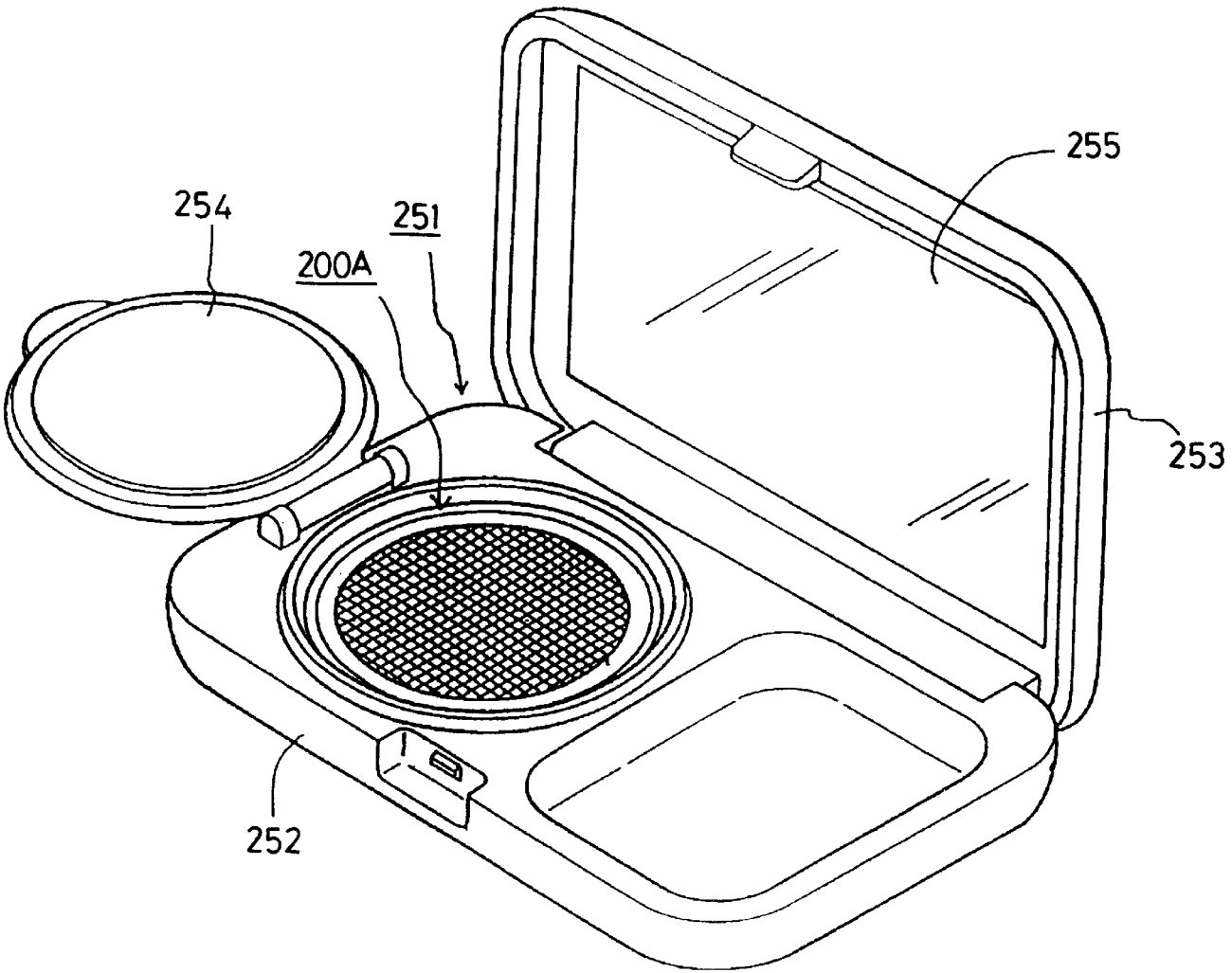
FIG. 19 is a perspective view showing an inner lid type compact cosmetic case.
Figure 20:
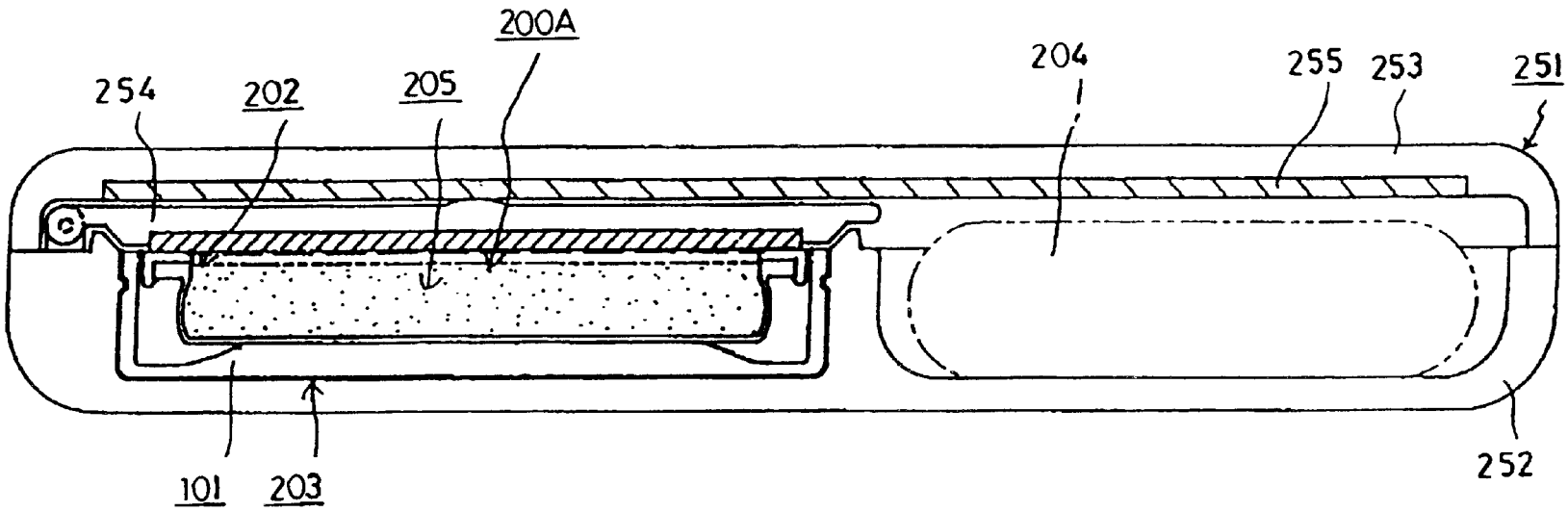
FIG. 20 is a cross section showing the inner lid type compact cosmetic case.

FIG. 19 is a perspective view showing a so-called inner lid type compact cosmetic case 251 in which the refillable case 200A and a cosmetic tool 204 are arranged in parallel and in which an inner lid is disposed in opposition to the refillable case 200A; FIG. 20 is a cross section showing the compact cosmetic case 251 in a closed state.

In FIG. 19, the body 252 and the lid 253 are structured in substantially the same manner as the parallel type compact cosmetic case shown in FIG. 15, and the containing method for the refillable case 200A of the body 252 is also substantially the same. An inner lid 254 that is pivotable with respect to the body 252 is arranged at a position opposing to the refillable case 200A of the body 252, and opening and closing of the compact cosmetic case 251 and the refillable case 200A can be done separately.

Thus, closing of the refillable case 200A can be done by the inner lid 254 provided on the body 252, so that a large mirror 255 can be mounted on an inner surface of the lid 253. The compact cosmetic case 251 thus structured has a larger area and a thicker thickness, but can use a larger size mirror, so that usage of the case can be improved.

It is to be noted that in the above embodiments, to prevent the inner case 201 contained in the recess 203*a* of the outer case 203 or the recess 212*a* formed in the body 212 of the compact cosmetic case 211, the annular engagements 203*d*, 212*d* are formed in the recesses 203*a*, 212*a* where the engagement projection 202*d* is formed at the net frame 202, but this invention is not limited to this. The bottom plate 212*b* of the body 212 of the compact cosmetic case 211 can adhere to the bottom surface 201*a* of the inner case 201 and to the bottom plate 203*b* of the outer case 203.

It is also to be noted that, as shown FIG. 3 and FIG. 5 of the first and the second embodiment, an annular coupling portion between the annular engagement member 202*a* and the net 202*b* can be placed upright, so that the level of the net 202*b* is positioned higher than the surface of the annular engagement member 202*a*. That is, the net 202*b* is located above as floating over the annular engagement member 202*a*.

It is also to be noted that the examples of the compact cosmetic cases thus described and shown in FIGS. 15 to 20 can be used for the following eighth to fourteenth embodiments.

Figure 21:
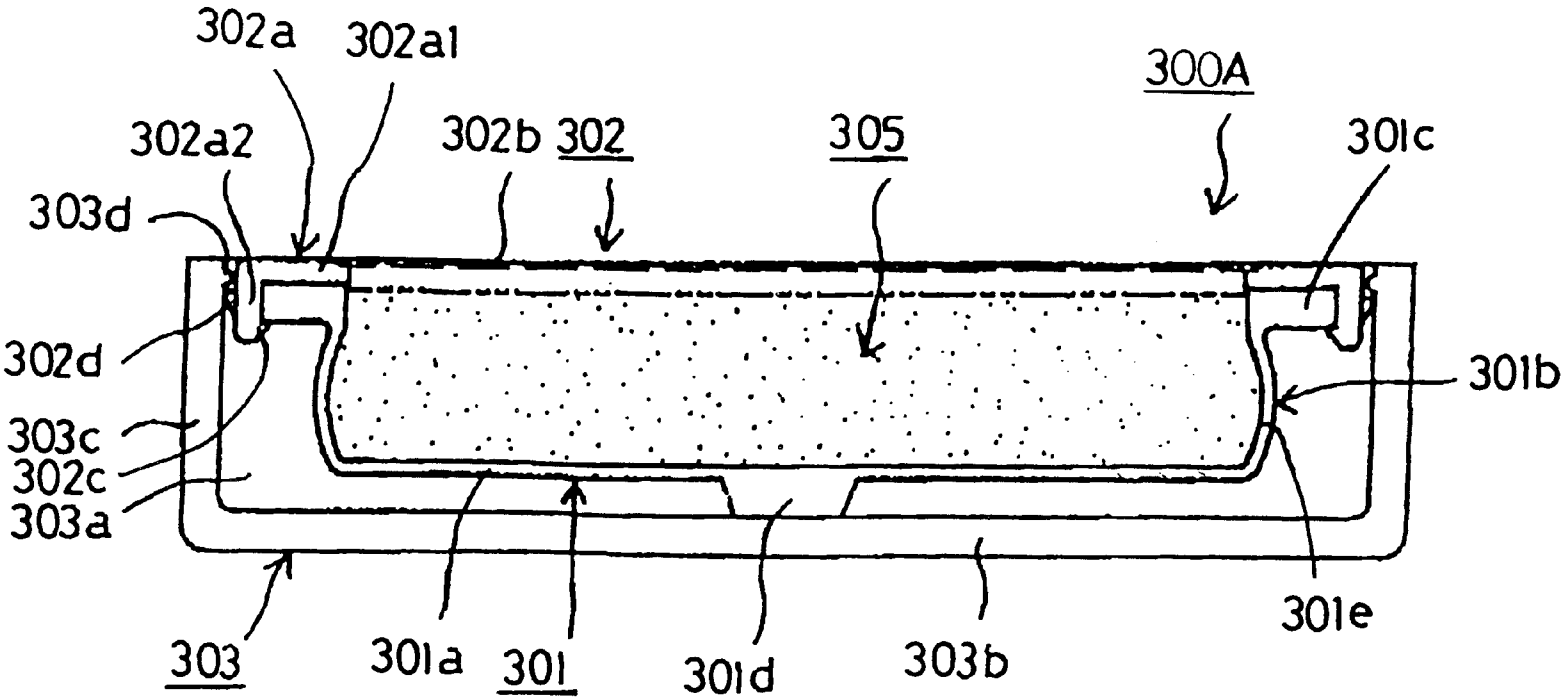
FIG. 21 is a cross section showing a structure of a refillable case according to an eighth embodiment of the invention.
Figure 22:
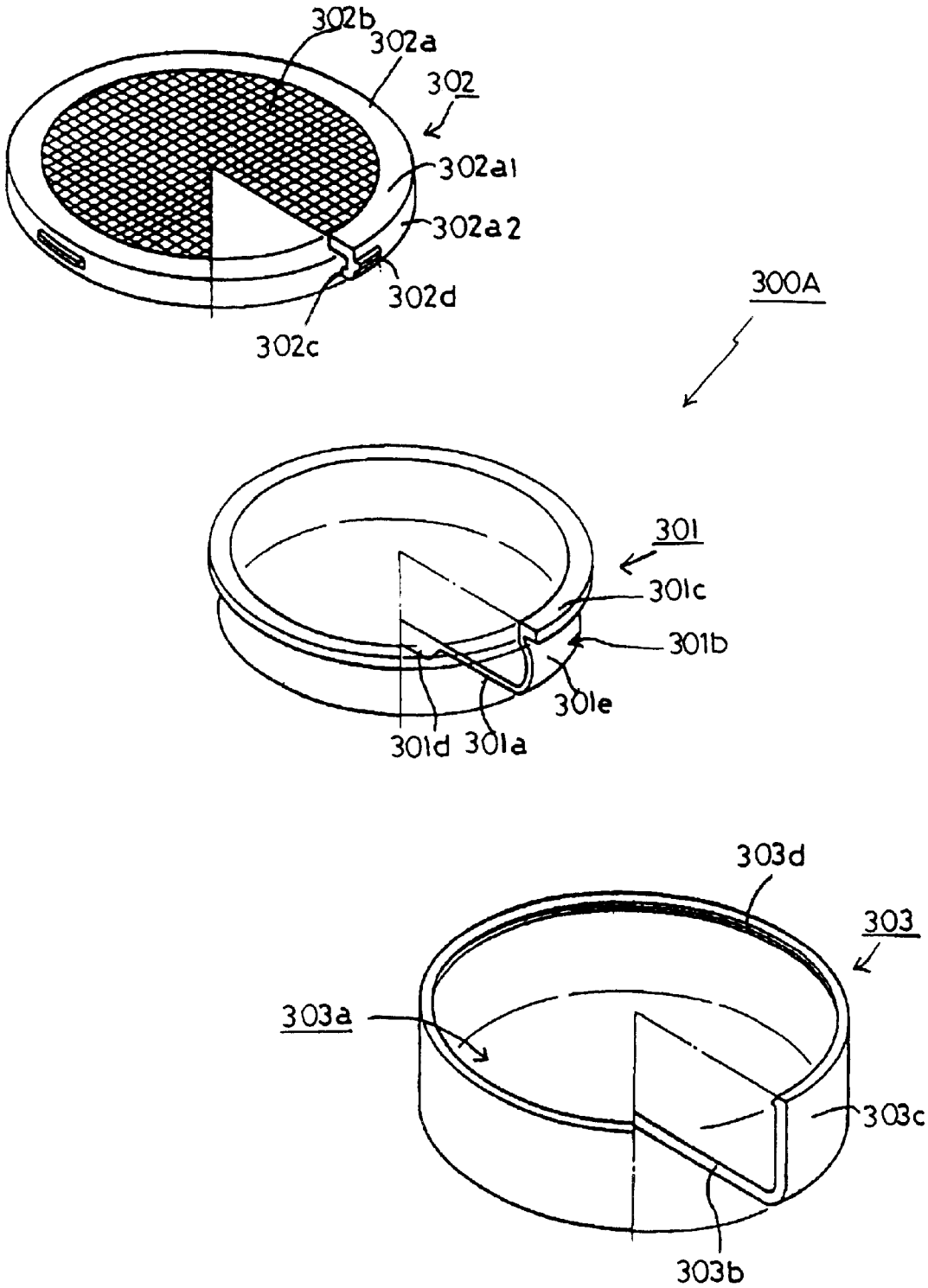
FIG. 22 is an exploded view showing the refillable case according to the eighth embodiment of the invention.

First, FIG. 21 is a cross section showing a refillable case 300A according to the eighth embodiment of the invention; FIG. 22 is an extended view showing the refillable case 300A. A bottom surface 301*a* of the inner case 301 is formed as a flat surface. A side surface 301*b* extends upright from the bottom surface 301*a*, and a brim 301*c* is formed in projecting in an outer peripheral direction on a top end of the side surface 301*b*. The bottom surface 301*a* and the side surface 301*b* are formed with substantially the same thickness, and the brim 301*c* is formed thicker than the bottom surface 301*a* and the side surface 301*b*. Accordingly, the brim 301*c* has a higher rigidity than those of the bottom surface 301*a* and the side surface 301*b*.

A projection 301*d* in a truncated cone shape is formed at approximately the center of the bottom surface 301*a* of the inner case 301. The end of the projection 301*d* touches the bottom plate 303*b* of the outer case 303 described below, and the bottom surface 301*a* corresponding to the projection 301*d* is prevented from moving toward the bottom plate 303*b*, where the bottom surface 301*a* other than the portion at which the projection 301*d* is formed is allowed to move toward the bottom plate 303*b*. Therefore, when the inner case 301 is pushed by suppressing force operating to the net 302*b*, the bottom surface 301*a* located radially outside the projection 301*d* is deformed in moving toward the bottom plate 303*b* (see, FIG. 25).

A curving portion 301*c* that curves outward in an arc shape is formed at the side surface 301*b* of the inner case 301, so that the side surface 301*b* has a form like a drum by this curving portion 301*e*. The shape of the curving portion formed at the side surface 301*b* of the inner case 301 is not limited to the curving portion 301*b* in the arc shape curving outward as shown in the embodiment, and can be a curving portion formed in an unequal sign shape ("<") oriented outward or oriented inward.

The net frame 302 includes an annular engagement 302*a* for engaging the brim 301*c* of the inner case 301*c* upon fitting to the brim 301*c*, and a net 302*b* secured to the annular engagement 302*a*. The annular engagement 302*a* includes a ring portion 302*a*1 having substantially the same width as that of the brim 301*a*, and an engagement 302*a*2 extending downward from the outer periphery of the ring portion 302*a*1.

An engagement projection 302*c* is placed at a position corresponding to the thickness of the brim 301*c* on an inner peripheral surface of the engagement 302*a*2. The engagement projection 302*c* is not necessarily engaged with the entire periphery of the brim 301*c*, and when the net frame 302 is fitted to the inner case 301, the engagement portion 302*c* may, without more, hold as to prevent the net frame 302 from disengaging from the inner case 301. In this embodiment, the engagement portion 302*a*2 is divided equally to four portions at which the engagement projection 302*c* is formed. An engagement projection 302*d* similar to the engagement projection 302*c* is formed on the outer peripheral surface of the engagement 302*a*2 at a position corresponding to the annular engagement 303*d* formed on the inner peripheral surface of the outer case 303.

The outer case 303 is formed with a recess 303*a* containing the inner case 301 to which the net frame 302 is engaged, and a bottom plate 303*b* limits the depth of the recess 303*a*. That is, a plane shape of the recess 303*a* is substantially the same as the plane shape of the net frame 302, and the bottom plate 303*b* is formed at a position to make it larger than the distance from the bottom surface 301*a* of the inner case 301 to the surface of the ring portion 302*a*1 of the net frame 302. In this embodiment, the outer case 303 is formed in a cylindrical shape whose bottom is defined by a bottom plate 303*b*, and the recess 303*a* is formed within the cylinder portion 303*c* having a prescribed thickness.

An annular engagement 303*d* is formed at a prescribed position on the inner peripheral surface on a top end of the cylinder portion 303*c*. The annular engagement 303*d* has a function to prevent the inner case 301, that is contained in the recess 303*a* upon engagement with the engagement projections 302*d* formed at the engagement portions 302*a*2 of the net frame 302 in engaging with the net frame 302, from disengaging from the recess 303*a*.

As described above, with the refillable case 300A formed with the projection 301*d* on the bottom surface 301*a* of the inner case 301, when the inner case 301 is pushed during use, the formed portion of the projection 301*d* of the bottom surface 301*a* is prevented from deforming, and the bottom surface 301*a* comes closer to the net 302*b*. Therefore, the powdery cosmetic material 305 contained in the inner case 301 can be applied easily to the cosmetic tool 304.

Steps for composing the refillable case 300A with the inner case 301, the net frame 302, and the outer case 303 are substantially the same as the above embodiments shown in FIG. 13.

Figure 23:
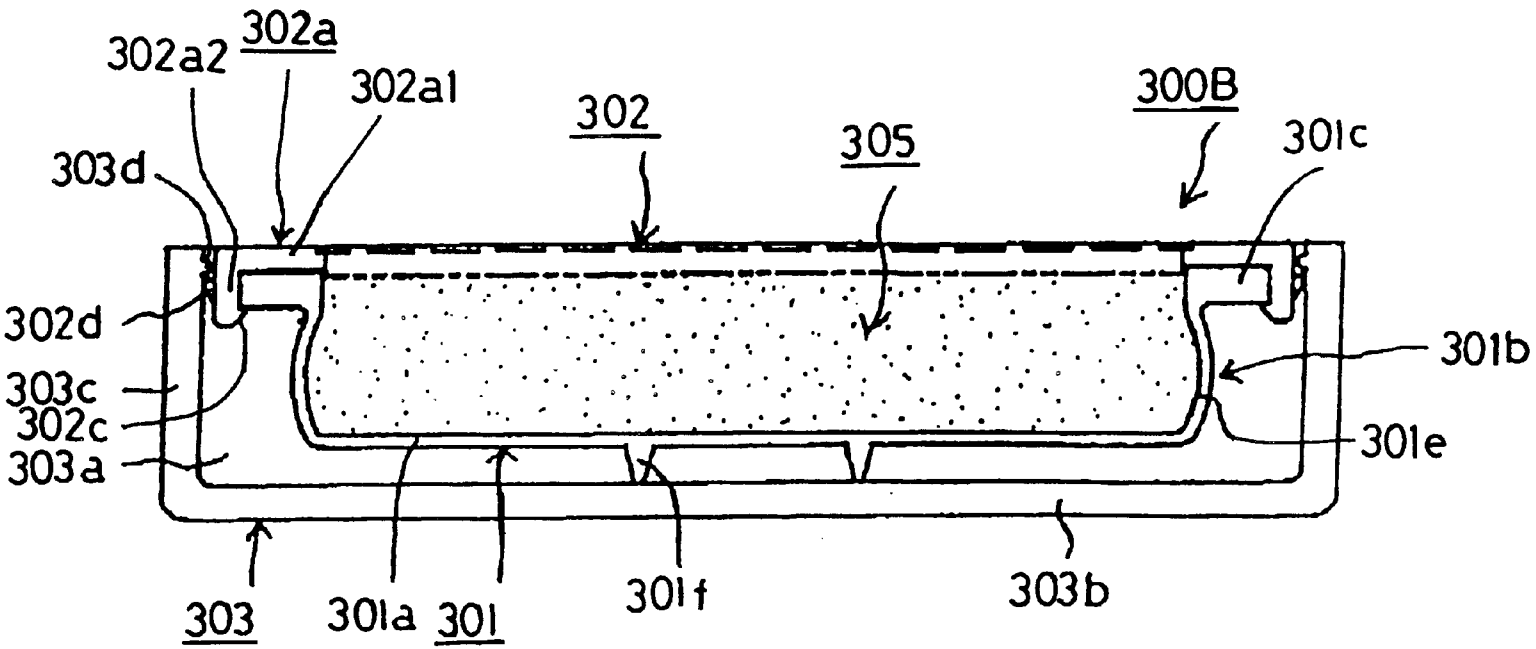
FIG. 23 is a cross section showing a structure of a refillable case according to a ninth embodiment of the invention.

FIG. 23 is a cross section showing a refillable case 300B according to the ninth embodiment of the invention. In this drawing, the same portions as those in the above first embodiment have the same reference numbers. The refillable case 300B in this embodiment is structured in the same manner except that the shape of the projection 301*f* formed on the bottom surface 301*a* of the inner case 301 is different from the shape of the projection 301*d* in the eighth embodiment.

As shown in FIG. 23, a projection 301*f* in a ring shape having a prescribed diameter is formed at approximately the center of the bottom surface 301*a* of the inner case 301, and the projection 301*f* is in contact with the bottom plate 303*b*. The projection 301*f* is therefore in circled contact linearly with the bottom plate 303*b*.

As described above, the inner case 301 having the projection 301*f* in the ring shape on the bottom surface 301*a* can be easily deformed in a wider area in comparison with the projection 301*d* in a truncated cone shape as in the first embodiment, so that the powdery cosmetic material 305 contained in the inner case 301 is guaranteed to keep its fluidity.

Figure 24:
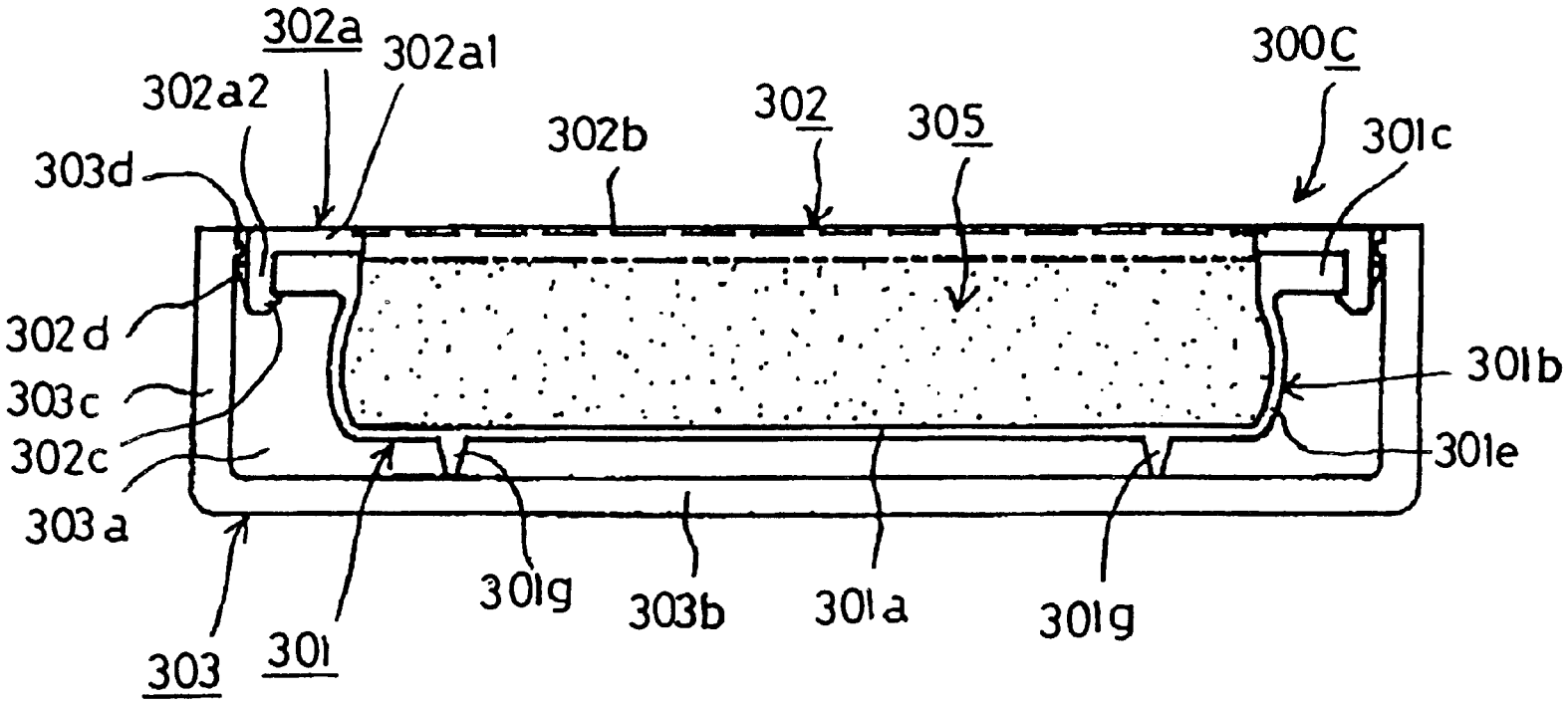
FIG. 24 is a cross section showing a structure of a refillable case according to a tenth embodiment of the invention.

FIG. 24 is a cross section showing a structure of a refillable case 300C according to a tenth embodiment of the invention. In this drawing, the same portions as those in the above ninth embodiment have the same reference numbers. The refillable case 300C in this embodiment has a plurality of projections 303*g* whose plane shape is in an arc shape formed at the bottom surface 301*a* of the inner case 301. Accordingly, the bottom surface 301*a* of the inner case 301 is in contact with the bottom plate 303*b* of the outer case 303 by the plurality of the arcs. The plurality of the projections 301*g* is located coaxially on the same circumference from the center of the bottom surface 301*a*.

With the inner case 301 having the plurality of the arc shaped projections 301*g* at the bottom surface 301*a*, the inner case 301 can be easily deformed in a wider area according to pushing force in substantially the same manner as the ninth embodiment. Since the bottom surface 301*a* is deformed from the plurality of arcs as original points, the contained powdery cosmetic material 305 can be made fluid positively in accordance with this deformation. The powdery cosmetic material 305 is therefore prevented from solidifying and guarantees the fluidity in the material. It is to be noted that an annular projection may be formed by extending the plural projections 301*g* continuously, not shown. At that time, the bottom surface 301*a* is deformed at the projections as a boundary, so that the powdery cosmetic material 305 is therefore prevented from solidifying and guarantees the fluidity in the material.

Figure 25:
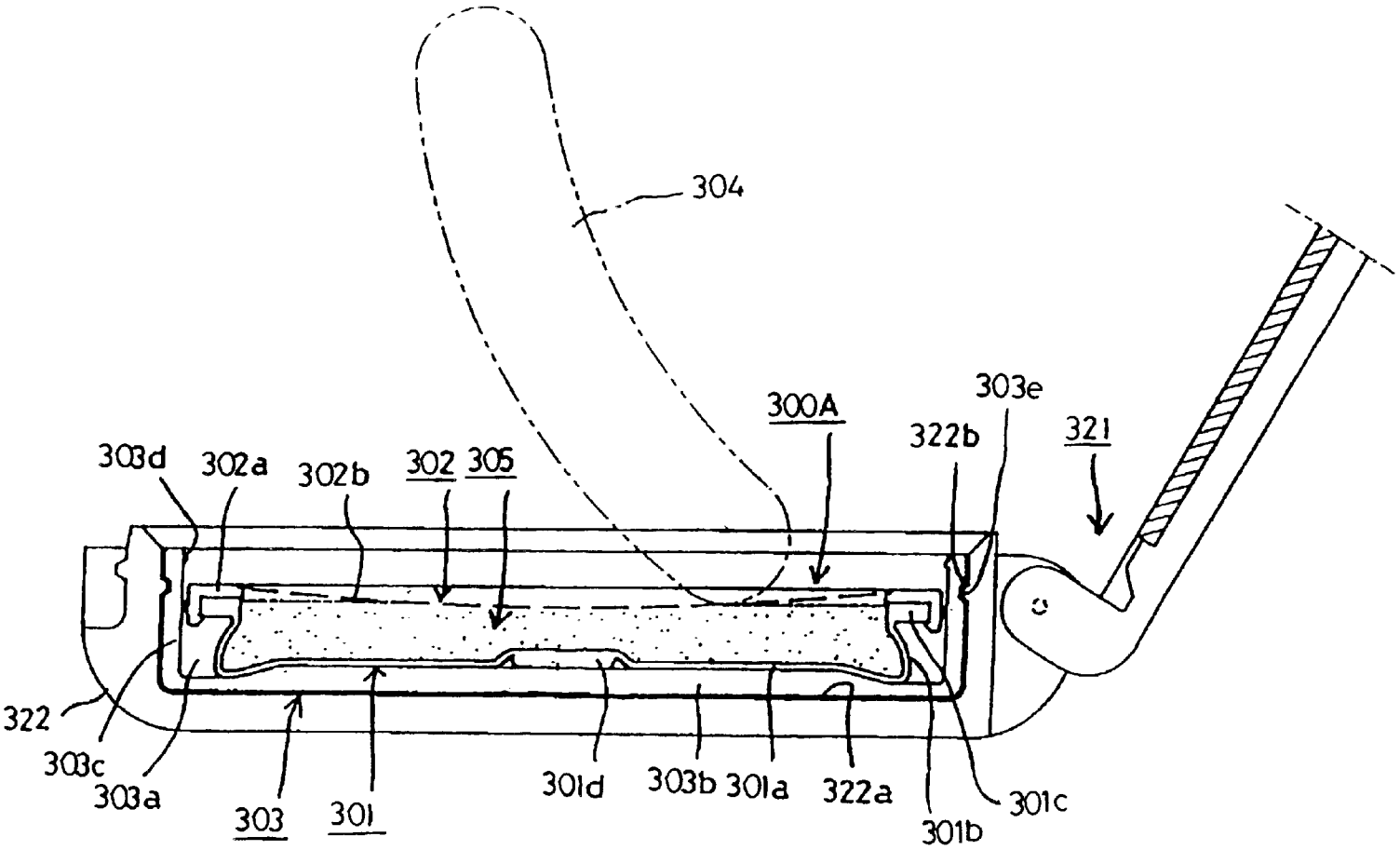
FIG. 25 is a cross section showing a deformed state of the inner case while a refillable case is used.

Referring to FIG. 25, fluidity in the powdery cosmetic material 305 during use of the refillable case thus structured is described. In this drawing, as a refillable case, the refillable case 300A according to the eighth embodiment is used, and the outer case 303 of the refillable case 300A is contained within a containing section 322*a* formed in the body 322 of the compact cosmetic case 321. It is to be noted that an engagement groove 303*e* is formed on an outer peripheral surface of the outer container 303 and that the groove 303*e* prevents the outer case 303 from disengaging from the body 322 of the refillable case 300A by engagement with the engagement projection 322*b* formed at the containing section 322*a* of the body 322.

When the powdery cosmetic material 305 is contained much in the inner case 301 in the refillable case 300A, and when a cosmetic tool 304 is lightly pushed onto the net 302, the net 302 is bent slightly by this pushing force to contact with the topmost surface of the powdery cosmetic material 305, so that the powdery cosmetic material 305 transfers on the cosmetic tool 304 in exposing itself on the net 302 in passing the net 302.

According to reduction of the powdery cosmetic material 305 contained in the inner case 301, the net 302 may not come into contact with the powdery cosmetic material 305 even where cosmetic tool 304 is pushed on the net 302*b*, so that larger force to push the cosmetic tool 304 is required. This pushing force is transmitted, at the same time as the net 302*b* is bent, to the side surface 301*b* and the bottom surface 301*a* via the annular engagement 302*a* and the brim 301*c* from the net 302*b*. The net frame 302 moves according to application of the pushing force toward the bottom plate 303*b* of the outer case 303. Since the bottom surface 301*a* of the inner case 301 is in contact with the bottom plate 303*b* of the outer case 303, the bottom surface 301*a* is supported along the bottom plate 303*b* to bend the side surface 301*b* as to deform the side surface, thereby reducing the volume of the inner case 301.

The topmost level of the powdery cosmetic material 305 contained in the inner case 301 is therefore lifted up relatively to contact with the net 302*b*, and the powdery cosmetic material 305 is exposed upon passing the net 302*b* and attached to the cosmetic tool 304. According to the deformation of the bottom surface 301*a* and the side surface 301*b*, the contained powdery cosmetic material 305 is made fluid within the inner case 301 to prevent the material from solidifying, so that the refillable case can keep the powder state. When the cosmetic tool 304 is separated from the net 302*b*, the bottom surface 301*a* and the side surface 301*b* of the inner case 301 return to the original form, and the contained powdery sheet materials 305 is agitated by passing air through the net 302*b* as to flow through the inside of the inner case 301 during this returning process, so that the cosmetic material 305 can be effectively prevented from solidifying.

As described above, in the inner case 301, the side surface 301*b* and the bottom surface 301*a* are deformed according to the size of force exerting to the net 302*b*. Since the contained powdery cosmetic material 305 is compulsively made fluid according to deformation of the inner case 301, the cosmetic material 5 can always keep the fluidity without solidifying.

Figure 32:
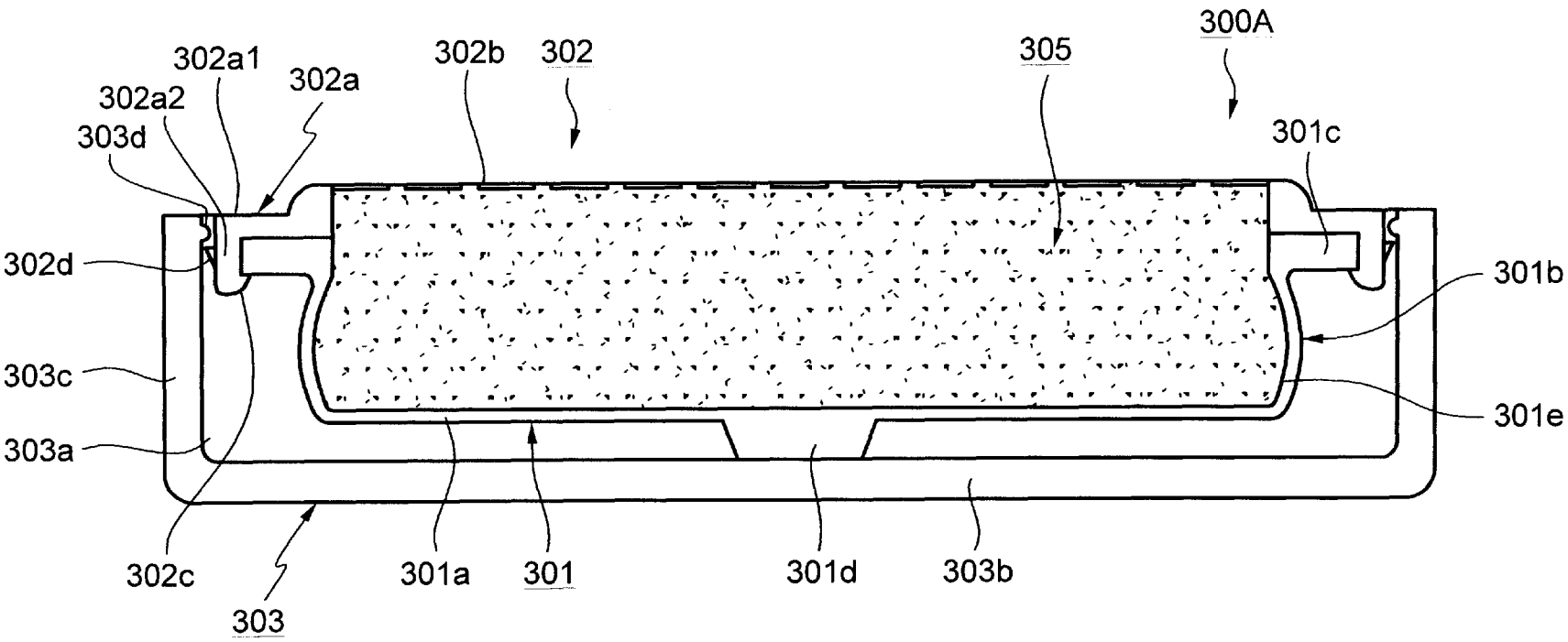
FIG. 32 is a cross section showing a structure of a refillable case.

It is to be noted that, as shown FIG. 3 and FIG. 5 of the first and the second embodiments, an annular coupling portion between the annular engagement member 302*a* and the net 302*b* could be placed upright, so that the level of the net 302*b* is positioned higher than the surface of the annular engagement member 302*a*. That is, as shown in FIG. 32 the net 302*b* is located above as floating over the annular engagement member 302*a*.

Figure 26:
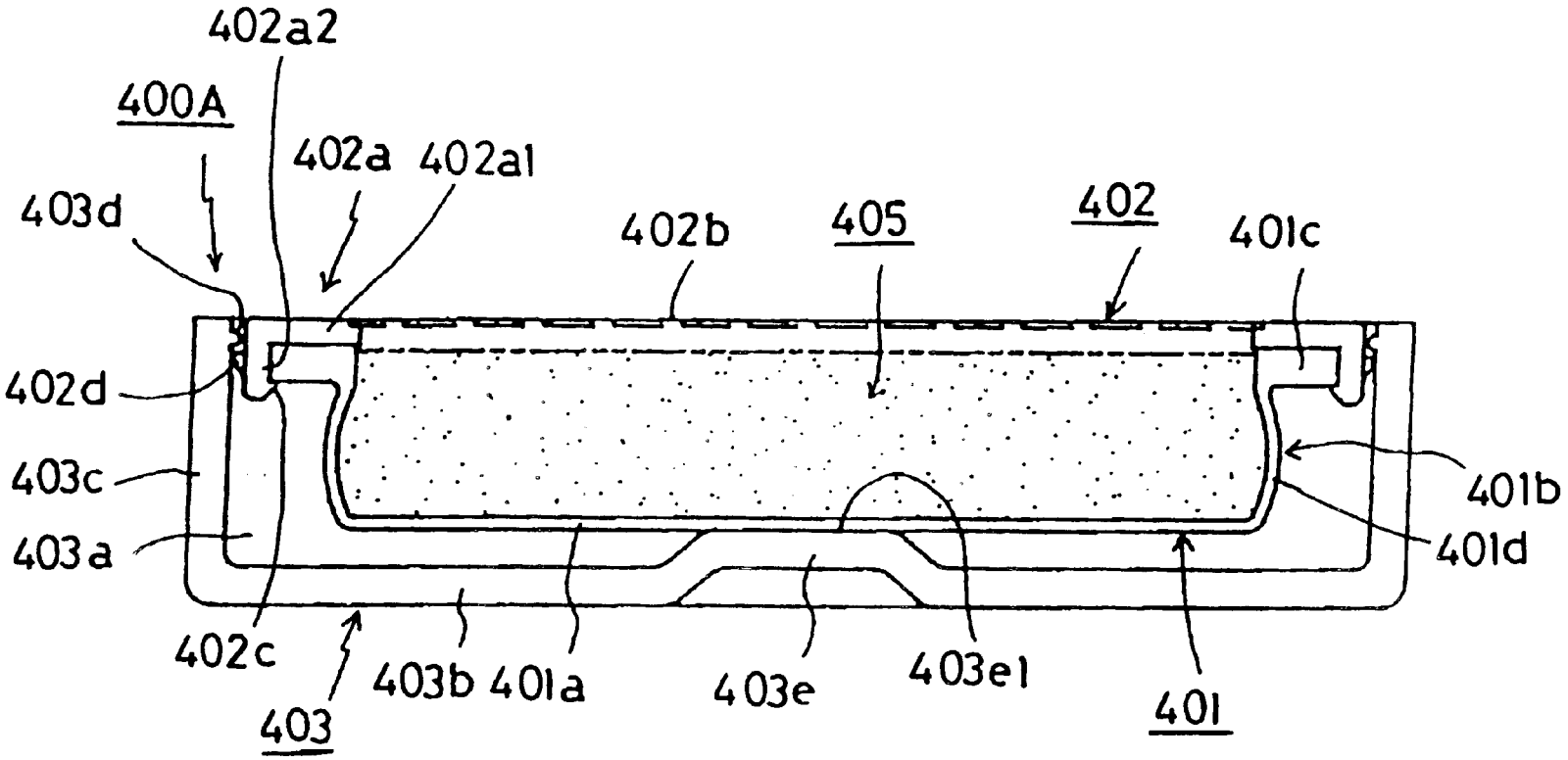
FIG. 26 is a cross section showing a structure of a refillable case according to an eleventh embodiment of the invention.
Figure 27:
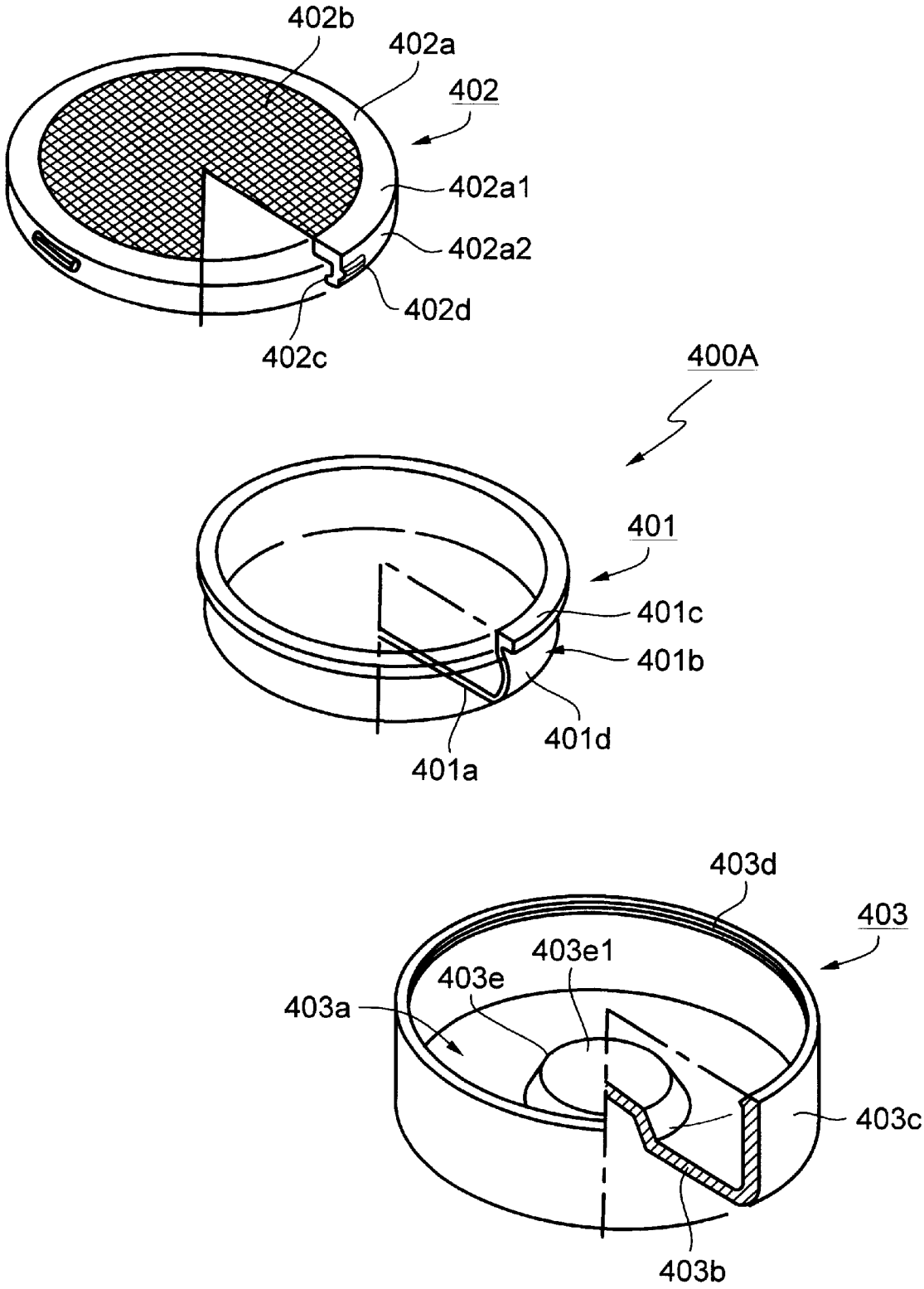
FIG. 27 is an exploded view showing the refillable case according to the eleventh embodiment of the invention.

FIG. 26 is a cross section showing a refillable case 400A according to the eleventh embodiment of the invention; FIG. 27 is an extended view showing the refillable case 400A. A bottom surface 401*a* of the inner case 401 is formed as a flat surface. A side surface 401*b* extends upright from the bottom surface 401*a*, and a brim 401*c* is formed in projecting in an outer peripheral direction on a top end of the side surface 401*b*. The bottom surface 401*a* and the side surface 401*b* are formed with substantially the same thickness, and the brim 401*c* is formed thicker than the bottom surface 401*a* and the side surface 401*b*. Accordingly, the brim 401*c* has a higher rigidity than those of the bottom surface 401*a* and the side surface 401*b*. A curving portion 401*d* that curves outward in an arc shape is formed at the side surface 401*b* of the inner case 401, so that the side surface 401*b* has a form like a drum by this curving portion 401*d*.

The shape of the curving portion formed at the side surface 401*b* of the inner case 401 is not limited to the curving portion 401*b* in the arc shape curving outward as shown in the embodiment, and can be a curving portion formed in an unequal sign shape ("<") oriented outward or oriented inward.

The net frame 402 includes an annular engagement 402*a* for engaging the brim 401*c* of the inner case 401*c* upon fitting to the brim 401*c*, and a net 402*b* secured to the annular engagement 402*a*. The annular engagement 402*a* includes a ring portion 402*a*1 having substantially the same width as that of the brim 401*a*, and an engagement 402*a*2 extending downward from the outer periphery of the ring portion 402*a*1.

An engagement projection 402*c* is placed at a position corresponding to the thickness of the brim 401*c* on an inner peripheral surface of the engagement 402*a*2. The engagement projection 402*c* is not necessarily engaged with the entire periphery of the brim 401*c*, and when the net frame 402 is fitted to the inner case 401, the engagement portion 402*c* may, without more, hold as to prevent the net frame 402 from disengaging from the inner case 401. In this embodiment, the engagement portion 402*a*2 is divided equally to four portions at which the engagement projection 402*c* is formed. An engagement projection 402*d* similar to the engagement projection 402*c* is formed on the outer peripheral surface of the engagement 402*a*2 at a position corresponding to the annular engagement 403*d* formed on the inner peripheral surface of the outer case 403.

The outer case 403 is formed with a recess 403*a* to contain the inner case 401 in which the net frame 402 is engaged, and a bottom plate 403*b* limits the depth of the recess 403*a*. That is, a plane shape of the recess 403*a* is substantially the same as the plane shape of the net frame 402, and the bottom plate 403*b* is formed at a position corresponding to a size of the distance from the bottom surface 401*a* of the inner case 401 to the surface of the ring portion 402*a*1 of the net frame 402, plus the height of the projection 403*e* formed on the bottom plate 403*b*. In this embodiment, the outer case 403 is formed in a cylindrical shape whose bottom is defined by a bottom plate 403*b*, and the recess 403*a* is formed within the cylinder portion 403*c* having a prescribed thickness.

An annular engagement 403*d* is formed at a prescribed position on the inner peripheral surface on a top end of the cylinder portion 403*c*. The annular engagement 403*d* has a function to prevent the inner case 401 that is contained in the recess 403*a* upon engagement with the engagement projections 402*d* formed at the engagement portions 402*a*2 of the net frame 402 in engaging with the net frame 402 from disengaging from the recess 403*a*.

A projection 403*e* projecting toward the recess 403*a* is formed at substantially the center of the bottom plate 403*b*. The projection 403*e* has a function to deform the bottom surface 401*a* by contacting with the bottom surface 401*a* of the inner case 401 when the inner case 401 is urged downward by pushing force when the cosmetic tool 404 is pushed onto the net 402. (see, FIG. 31)

The projection 403*e* is formed as a projection in a truncated cone shape at substantially the center of the bottom plate 403*b* of the outer case 403 and is structured as to contact on an area basis with the bottom surface 401*a* of the inner case 401. The area and height of the end 403*e*1 of the projection 403*e* are designed in advance corresponding to the area and the height of the bottom surface 401*a* of the inner case 401 as to ensure the fluidity of the powdery cosmetic material 405 contained in the inner case 401 during use of the refillable case 400A.

As described above, with the refillable case 400A formed with the projection 403*e* in the truncated cone shape on the bottom plate 403*b* of the outer case 403, when the inner case 401 is pushed during use, the bottom surface 401*a* is prevented from deforming at a contacting portion to the projection 403*e*, and the bottom surface 401*a* comes closer to the net 402*b*. Therefore, the powdery cosmetic material 405 contained in the inner case 401 can be applied easily to the cosmetic tool 404.

Steps for composing the refillable case 400A with the inner case 401, the net frame 402, and the outer case 403 are substantially the same as the above embodiments shown in FIG. 13.

Figure 28:
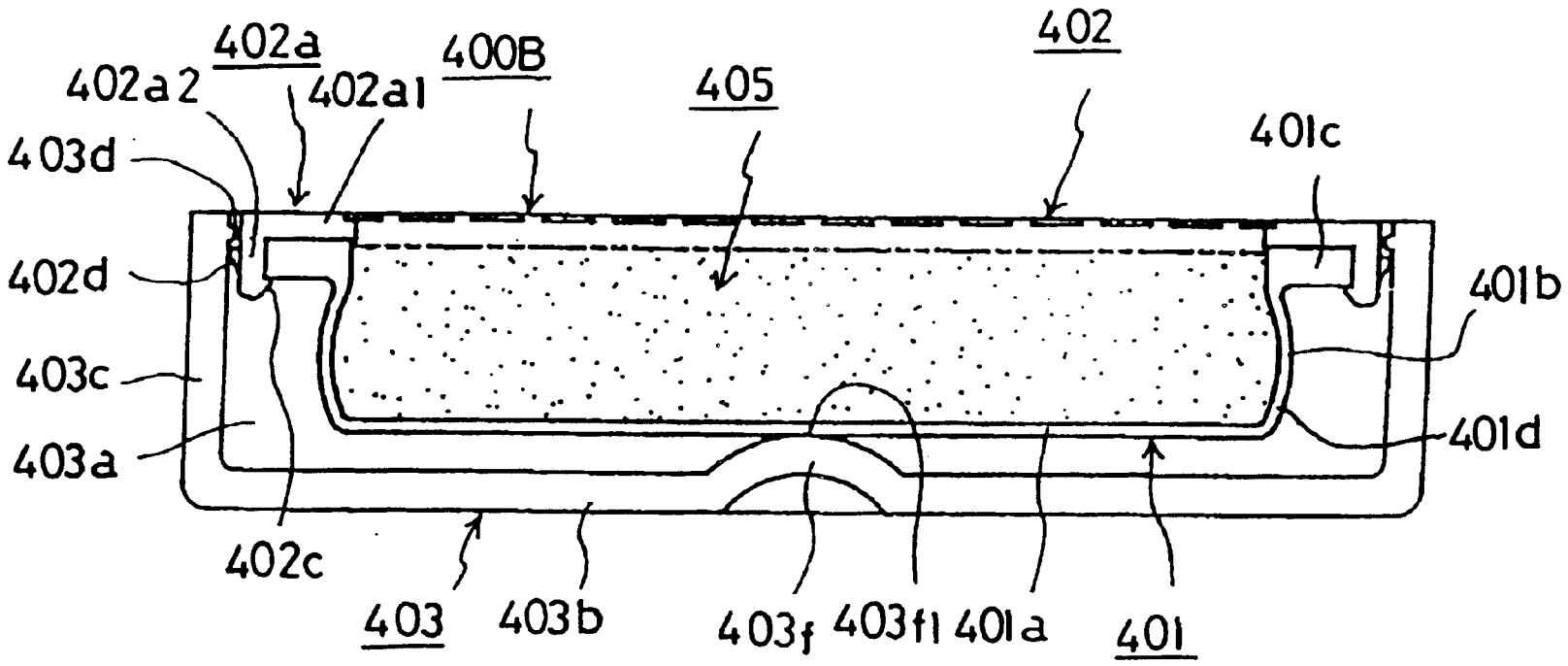
FIG. 28 is a cross section showing a structure of a refillable case according to a twelfth embodiment of the invention.

FIG. 28 is a cross section showing a refillable case 400B according to the twelfth embodiment of the invention. In this drawing, the same portions as those in the above eleventh embodiment have the same reference numbers. The refillable case 400B in this embodiment is structured in the same manner except that the shape of the projection formed on the bottom plate 403*a* of the outer case 403 is different from the shape of the projection 403*e* in the eleventh embodiment.

As shown in FIG. 28, a projection 403*f* in a hemisphere shape is formed at approximately the center of the bottom plate 403*b* of the outer case 403, and a summit 403*f*1 of the projection 403*f* is in contact with the bottom surface 401*a*. The projection 401*f* is therefore in point contact with the bottom surface 401*a*.

As described above, with the outer case 403 having the projection 403*f* in the hemisphere shape on the bottom plate 403*b*, the bottom surface 401*a* of the inner case 401 can be easily deformed by smaller force in comparison with the projection 403*e* in the truncated cone shape as in the eleventh embodiment, so that the powdery cosmetic material 405 contained in the inner case 401 is guaranteed to keep its fluidity.

Figure 29:
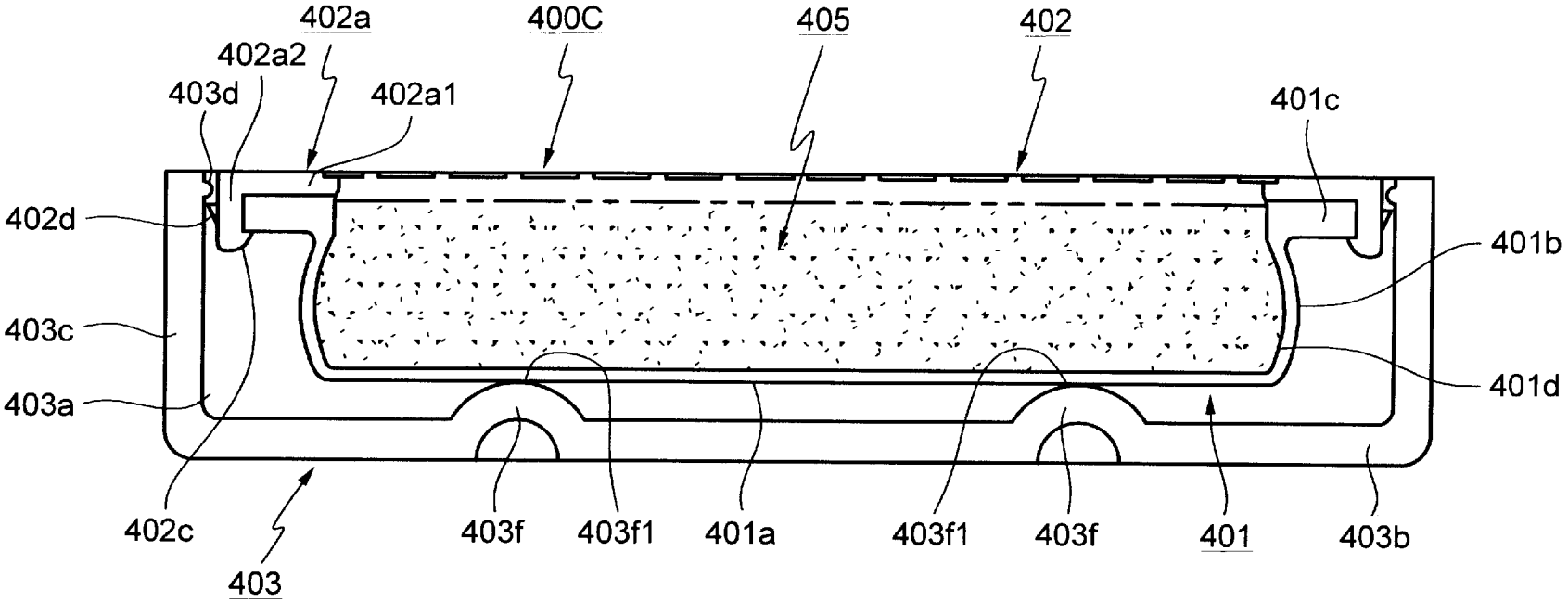
FIG. 29 is a cross section showing a structure of a refillable case according to a thirteenth embodiment of the invention.

FIG. 29 is a cross section showing a structure of a refillable case 400C according to the thirteenth embodiment of the invention. In this drawing, the same portions as those in the above twelfth embodiment have the same reference numbers. The refillable case 400C in this embodiment has a plurality of projections 403*f* in a hemisphere shape formed at the bottom plate 403*b* of the outer case 403. Accordingly, the bottom surface 401*a* of the inner case 401 is in contact with the projections 403*f* by the plurality of the points. The plurality of the projections 403*f* is located coaxially on the same circumference from the center of the bottom plate 403*b*.

With the outer case 403 having the plurality of the hemisphere shaped projections 403*f* at the bottom plate 403*b*, the inner case 401 can be easily deformed by smaller pushing force in substantially the same manner as the twelfth embodiment. Since the bottom surface 401*a* is deformed from the plurality of points as original points, the contained powdery cosmetic material 405 can be made fluid positively in accordance with this deformation. The powdery cosmetic material 405 is therefore prevented from solidifying and guarantees the fluidity in the material. It is to be noted that an annular projection, not shown, may be formed by extending the plural projections 403*f* continuously. At that time, the projection is in annular contact with the bottom surface 401*a* of the inner case 401, and when the pushing force is applied to the inner case 401, the bottom surface 401*a* is deformed at the projections as a boundary, so that the powdery cosmetic material 405 is therefore prevented from solidifying and guarantees the fluidity in the material.

Figure 30:
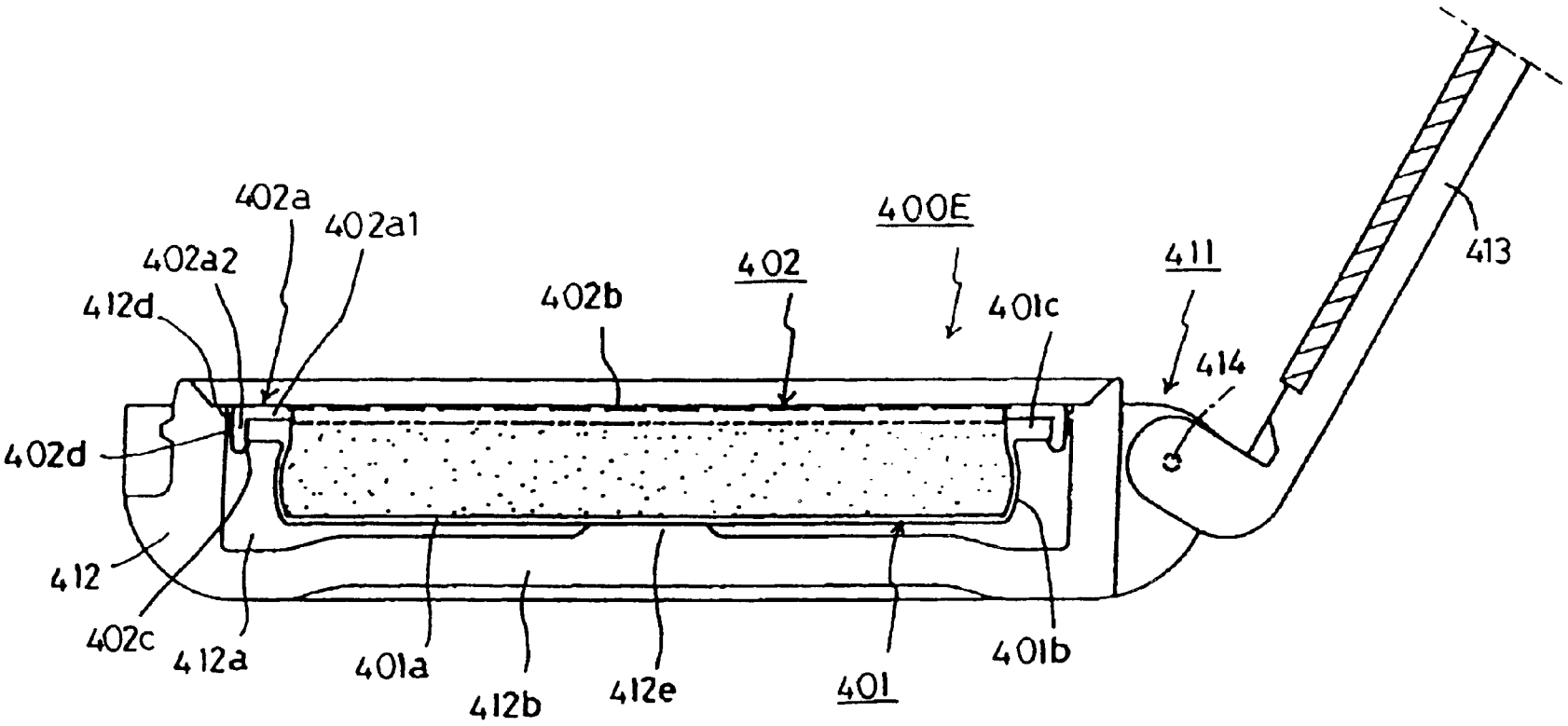
FIG. 30 is a cross section showing a deformed state of the inner case while a refillable case is used according to a fourteenth embodiment of the invention.

A refillable case 400E according to the fourteenth embodiment of the invention shown in FIG. 30 has an outer case serving as a body 412 of the compact cosmetic case 411, and an inner case 401 united with the net frame 402 is contained within a recess 412*a* formed in the body 412. The inner case 401 and the net frame 402 are the same as those in the first embodiment. In FIG. 30, the compact cosmetic case 411 has the body 412 and a lid 413, which are mounted as to be openable by a hinge pin 414. The recess 412*a* for containing the inner case 401 is formed at a prescribed position of the body 412.

The recess 412*a* is formed with the same specification as the recess 403*a* in above embodiments. That is, a projection 412*e* is formed on the bottom plate 412*b* of the recess 412*a*, and an annular engagement 412*d* is formed on the top. The inner case 401 contained in the recess 412*a* is prevented from moving in a direction disengaged from the recess 412*a* by engaging the engagement projection 402*d* of the net frame 402 with the annular engagement 412*d* formed at the recess 412*a*, thereby allowing to move only downward of the recess 412*a*.

As described above, as the outer case for containing the inner case 401 with which the net frame 402 is united, an outer case (412) is not necessarily in a cylinder shape having a bottom, and works as far as recesses 403*a,* 412*a* capable of containing the inner case 401. That is, the outer shape of the outer case (412), can be made in various shapes such as a cylindrical shape or a plate shape.

Figure 31:
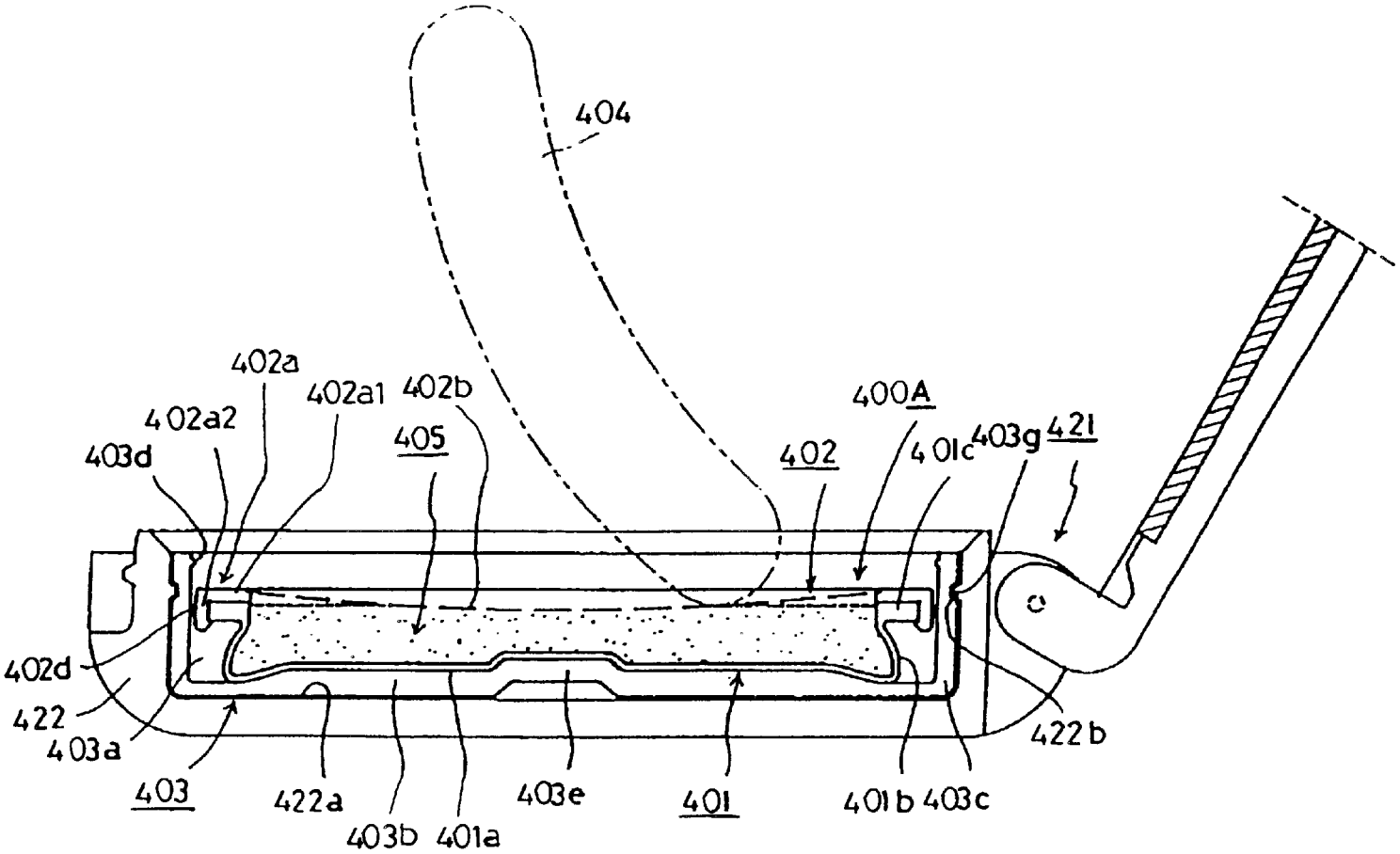
FIG. 31 is a cross section showing a deformed state of the inner case while a refillable case is used.

Referring to FIG. 31, fluidity in the powdery cosmetic material 405 during use of the refillable case thus structured is described. In this drawing, as a refillable case, the refillable case 400A according to the first embodiment is used, and the outer case 403 of the refillable case 400A is contained within a containing section 422*a* formed in the body 422 of the compact cosmetic case 241. It is to be noted that an engagement groove 403*g* is formed on an outer peripheral surface of the outer container 403 and that the groove 403*g* prevents the outer case 403 from disengaging from the body 422 of the refillable case 400A by engagement with the engagement projection 422*b* formed at the containing section 422*a* of the body 422.

When the powdery cosmetic material 405 is contained much in the inner case 401 in the refillable case 400A, and when a cosmetic tool 404 is lightly pushed onto the net 402, the net 402 is bent slightly by this pushing force and makes contact with the topmost surface of the powdery cosmetic material 405, so that the powdery cosmetic material 405 transfers on the cosmetic tool 404 in exposing itself on the net 402 in passing the net 402.

According to reduction of the powdery cosmetic material 405 contained in the inner case 401, the net 402 may not come into contact with the powdery cosmetic material 405 even where cosmetic tool 404 is pushed onto the net 402*b,* so that larger force to push the cosmetic tool 404 is required. This pushing force is transmitted, at the same time as the net 402*b* is bent, to the side surface 401*b* and the bottom surface 401*a* via the annular engagement 402*a* and the brim 401*c* from the net 402*b*. The net frame 402 moves according to application of the pushing force toward the bottom plate 403*b* of the outer case 403. Since the bottom surface 401*a* of the inner case 401 is in contact with the bottom plate 403*b* (as well as the projection 403*e*) of the outer case 403, the bottom surface 401*b* is supported along the bottom plate 403*b* to bend the side surface 401*b* as to deform the side surface, thereby reducing the volume of the inner case 401.

The topmost level of the powdery cosmetic material 405 contained in the inner case 401 is therefore lifted relatively to contact with the net 402*b,* and the powdery cosmetic material 405 is exposed upon passing the net 402*b* and attached to the cosmetic tool 404. According to the deformation of the side surface 401*b,* the contained powdery cosmetic material 405 is made fluid within the inner case 401 to prevent the material from solidifying, so that the refillable case can keep the powder state. When the cosmetic tool 404 is separated from the net 402*b,* the side surface 401*b* of the inner case 401 returns to the original form, and the contained powdery sheet materials 405 is agitated by passing air through the net 402*b* as to flow through the inside of the inner case 401 during this returning process, so that the cosmetic material 405 can be effectively prevented from solidifying.

As described above, in the inner case 401, the side surface 401*b* is deformed according to the size of force exerting to the net 402*b*. Since the contained powdery cosmetic material 405 is compulsively made fluid according to deformation of the inner case 401, the cosmetic material 5 can always keep the fluidity without solidifying.

It is also to be noted that, as shown FIG. 3 and FIG. 5 of the first and the second embodiments, an annular coupling portion between the annular engagement member 402*a* and the net 402*b* could be placed upright, so that the level of the net 402*b* is positioned higher than the surface of the annular engagement member 402*a*. That is, the net 402*b* is located above as floating over the annular engagement member 402*a*.

According to the invented refillable case, the bottom surface of the inner case is formed as a substantially flat shape, so that a containing amount of the powdery cosmetic material can be increased.

Molding the inner case with an elastic synthetic resin material as well as forming the curving portion on the side surface allows the inner case to be deformed according to the force exerted to the net frame at every time of use, thereby compulsively making the contained cosmetic material fluid according to this deformation. Thus, this invention has a feature that the powdery cosmetic material is prevented from solidifying and that can keep the powder state of the cosmetic material.

Similarly, molding the inner case with an elastic synthetic resin material as well as forming the curving portion on the side surface and the projection or the projections on the prescribed portion of the bottom plate of the outer case or on the bottom surface as to contact with the bottom plate of the outer case, allows the inner case to be deformed according to the force exerted to the net frame at every time of use, thereby compulsively making the contained cosmetic material fluid according to this deformation. Thus, this invention has a feature that the powdery cosmetic material is prevented from solidifying and that can keep the powder state of the cosmetic material.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but defined claims set forth below.

What is claimed is:

1. A refillable case for a powdery material, comprising:

a case body made of an elastic material, said case body having an opening opened upward for containing the powdery material; and a net frame attached to said case body to cover the opening of the case body, the net frame including, a net, an annular engagement member that engages said case body, and an annular coupling portion provided on top of the annular engagement member to support the net at a position higher than the annular engagement member.

2. The refillable case of claim 1, wherein the powdery material is a powdery cosmetic material.

3. The refillable case of claim 1, wherein the elastic material is a synthetic resin.

4. A refillable case for a powdery material, comprising:

an inner case made of an elastic material for containing the powdery material therein, the inner case including, a substantially flat bottom surface, a side surface extending in an upward direction from the bottom surface and having a curving portion that curves in at least one of inward and outward directions, a brim formed at a top edge of the side surface, said brim having a higher rigidity than the bottom surface and the side surface;

a net frame having an annular engagement member fitted to the brim of the inner case, said net frame further including an annular coupling portion, provided on top of said annular engagement member, for supporting a net at a position higher than said annular engagement member; and an outer case having a recess of a prescribed depth, into which the inner case is inserted.

5. The refillable case of claim 4, wherein the powdery material is a powdery cosmetic material.

6. The refillable case of claim 4, wherein the elastic material is a synthetic resin.

7. The refillable case of claim 4, further comprising:

a lid that covers the recess of the outer case, said lid having a deformable packing that seals the inner case to prevent the powdery material from leaking by engaging at least with the annular coupling portion when said lid is being closed.

8. A refillable case for a powdery material, comprising:

an inner case made of an elastic material for containing a powdery material therein, the inner case including, a substantially flat bottom surface, a projection formed on a prescribed position of the bottom surface, a side surface extending in an upward direction from the bottom surface and having a curving portion that curves in at least one of inward and outward directions, and a brim formed at a top edge of the side surface, said brim having a higher rigidity than the bottom surface and the side surface;

a net frame having an annular engagement member fitted to the brim of the inner case, said net frame further including an annular coupling portion, provided on top of said annular engagement member, for supporting a net at a position higher than said annular engagement member; and an outer case having a recess of a prescribed depth, into which the inner case is inserted, and a bottom plate in contact with the projection of the inner case.

9. The refillable case of claim 8, wherein the powdery material is a powdery cosmetic material.

10. The refillable case of claim 8, wherein the elastic material is a synthetic resin.

11. The refillable case of claim 8, further comprising:

a lid that covers the recess of the outer case, said lid having a deformable packing that seals the inner case to prevent the powdery material from leaking by engaging at least with the annular coupling portion when said lid is being closed.

12. A refillable case for a powdery material, comprising:

an inner case made of an elastic material for containing a powdery material therein, the inner case including, a substantially flat bottom surface, a side surface extending in an upward direction from the bottom surface and having a curving portion that curves in at least one of inward and outward directions, a brim formed at a top edge of the side surface, said brim having a higher rigidity than the bottom surface and the side surface;

a net frame having an annular engagement member fitted to the brim of the inner case, said net frame further including an annular coupling portion, provided on top of said annular engagement member, for supporting a net at a position higher than said annular engagement member; and an outer case having a recess of a prescribed depth, into which the inner case is inserted, and a bottom plate having a projection that makes contact with the bottom surface of the inner case.

13. The refillable case of claim 12, wherein the powdery material is a powdery cosmetic material.

14. The refillable case of claim 12, wherein the elastic material is a synthetic resin.

15. The refillable case of claim 4, further comprising:

a lid that covers the recess of the outer case, said lid having a deformable packing that seals the inner case to prevent the powdery material from leaking by engaging at least with the annular coupling portion when said lid is being closed.

16. A refillable case for a powdery material, comprising:

an inner case having an upper opening and containing a powdery material therein, the inner case including, a substantially flat bottom surface made of an elastic material, at least one projection formed on the bottom surface in a downward direction, a side surface formed integrally with said flat bottom surface and extending in an upward direction from the bottom surface, said side surface having a curving portion that deforms at least in one of inward and outward directions when a force is applied thereto, a brim formed at a top edge of the side surface, said brim having a higher rigidity than the bottom surface and the side surface;

a net frame having an annular engagement member fitted to the brim of the inner case and a net for covering the upper opening of the inner case; and an outer case made of a rigid material and having a recess for containing the inner case and slidably receiving said net frame therein, said outer case also having a bottom plate in contact only with the projection of the inner case when no downward force is applied to the net, wherein when a downward force is applied to said net, said net frame slides downward inside said outer case, deforms said side surface of the inner case in at least one of the inward and outward directions, and deflects said bottom surface of the inner case such that the bottom surface makes contact with the bottom plate of said outer case.

17. A refillable case for a powdery material, comprising:

an inner case having an upper opening and containing a powdery material therein, the inner case including, a substantially flat bottom surface made of an elastic material, a side surface formed integrally with said flat bottom surface and extending in an upward direction from the bottom surface, said side surface having a curving portion that deforms in at least one of inward and outward directions, a brim formed at a top edge of the side surface, said brim having a higher rigidity than the bottom surface and the side surface;

a net frame having an annular engagement member fitted to the brim of the inner case and a net for covering the upper opening of the inner case; and an outer case made of a rigid material and having a recess for containing the inner case and slidably receiving said net frame therein, said outer case also having a bottom plate provided with at least one projection protruding in an upward direction, said projection making contact only with the bottom surface of the inner case when no downward force is applied to the net, wherein when a downward force is applied to said net, said net frame slides downward inside said outer case, deforms said side surface of the inner case in at least one of the inward and outward directions, and deflects said bottom surface of the inner case such that the bottom surface makes contact with the bottom plate of said outer case.

* * * * *